US010232199B2

(12) United States Patent
Perner et al.

(10) Patent No.: US 10,232,199 B2
(45) Date of Patent: Mar. 19, 2019

(54) INTEGRAL SAFETY HARNESS CONNECTOR ASSEMBLY

(71) Applicant: D B Industries, LLC, Red Wing, MN (US)

(72) Inventors: Judd J. Perner, Red Wing, MN (US); David A. Schlangen, Red Wing, MN (US); Scott C. Casebolt, St. Paul Park, MN (US)

(73) Assignee: D B Industries, LLC, Maplewood, MN (US)

( * ) Notice: Subject to any disclaimer, the term of this patent is extended or adjusted under 35 U.S.C. 154(b) by 0 days.

(21) Appl. No.: 14/800,199

(22) Filed: Jul. 15, 2015

(65) Prior Publication Data

US 2016/0361577 A1 Dec. 15, 2016

Related U.S. Application Data

(60) Provisional application No. 62/173,823, filed on Jun. 10, 2015.

(51) Int. Cl.
*A62B 35/00* (2006.01)

(52) U.S. Cl.
CPC ..... *A62B 35/0037* (2013.01); *A62B 35/0031* (2013.01)

(58) Field of Classification Search
CPC . A63B 27/00; A62B 35/0031; A62B 35/0025; A62B 35/0006; A62B 35/0037
See application file for complete search history.

(56) References Cited

U.S. PATENT DOCUMENTS

| | | | | |
|---|---|---|---|---|
| 1,642,911 | A | 9/1927 | Thurnau | |
| 4,005,904 | A * | 2/1977 | Weman | B60R 22/24 24/163 R |
| 5,329,884 | A | 7/1994 | Bell | |
| 5,531,292 | A | 7/1996 | Bell | |
| 5,957,091 | A | 7/1999 | McDonald et al. | |

(Continued)

FOREIGN PATENT DOCUMENTS

| | | |
|---|---|---|
| JP | 2009261537 | 11/2009 |
| WO | 2000047098 | 8/2000 |
| WO | WO 00/47098 | 8/2000 |

OTHER PUBLICATIONS

International Search Report for PCT/US2016/036216 (4 pgs).

*Primary Examiner* — Daniel P Cahn

(57) ABSTRACT

A safety harness connector assembly including a D-ring, a device connector system and a shaft. The D-ring is generally a C-shape including a first end portion, a second end portion and mid-portion. The mid-portion extends between the first end portion and the second end portion. The first end portion has a first D-ring aperture and the second end portion having has a second D-ring aperture that is aligned with the first D-ring aperture. The device connector system includes at least one device connection aperture that is configured and arranged to couple a device to the safety harness connector assembly. The device connector system has at least one shaft connection aperture. A shaft is received in the first and second D-ring apertures of the D-ring and in the at least one shaft connection aperture of the device connector system to pivotally couple the device connector system to the D-ring.

17 Claims, 37 Drawing Sheets

(56) References Cited

U.S. PATENT DOCUMENTS 6,073,724 A * 6/2000 Wolner ..... E04G 21/3261 182/3
6,253,874 B1 7/2001 Casebolt et al.
6,382,355 B1 * 5/2002 Kowalewski ..... A63B 27/00 182/133
6,405,685 B1 6/2002 Cox
6,691,824 B2 2/2004 Sharp
6,739,427 B2 5/2004 Gayetty
6,971,476 B2 12/2005 Wolner et al.
7,392,881 B1 7/2008 Choate
8,091,151 B2 1/2012 Johnson et al.
8,177,025 B2 5/2012 Lang et al.
8,181,744 B2 * 5/2012 Parker ..... A62B 1/10 182/232
8,245,817 B2 8/2012 Casebolt
8,276,712 B2 10/2012 Smith et al.
8,312,966 B1 * 11/2012 Guthrie ..... E04G 5/045 182/3
8,336,503 B2 12/2012 Spinelli
8,375,467 B2 2/2013 Real et al.
8,424,638 B1 4/2013 Guthrie et al.
8,453,794 B2 * 6/2013 Melic ..... E04G 21/3276 182/230
8,490,750 B2 7/2013 Balquist et al.
8,678,134 B2 3/2014 Wood
8,959,664 B2 2/2015 Johnson et al.
9,121,462 B2 * 9/2015 Casebolt ..... A62B 1/10
2005/0067222 A1 * 3/2005 Casebolt ..... A62B 35/0037 182/30
2005/0082114 A1 * 4/2005 Casebolt ..... A62B 35/0037 182/3
2005/0194211 A1 9/2005 O'Shall et al.
2005/0205356 A1 9/2005 Velasco, Jr.
2005/0230183 A1 10/2005 Sharp
2006/0048723 A1 3/2006 Rohlf et al.
2006/0102423 A1 * 5/2006 Lang ..... A62B 35/0012 182/36
2007/0151805 A1 * 7/2007 Betcher ..... A62B 35/0093 182/239
2008/0060873 A1 * 3/2008 Lang ..... A62B 35/0018 182/3
2009/0173578 A1 * 7/2009 Renton ..... A62B 1/08 182/235
2009/0211849 A1 * 8/2009 Smith ..... A62B 35/0037 182/231
2010/0326767 A1 * 12/2010 Guthrie ..... A62B 35/0037 182/3
2012/0205478 A1 8/2012 Balquist et al.
2013/0104351 A1 * 5/2013 Casebolt ..... A62B 35/0037 24/522
2013/0104374 A1 * 5/2013 Schlangen ..... F16B 45/02 29/525.01
2013/0126269 A1 * 5/2013 Perner ..... A63B 27/02 182/9
2013/0248284 A1 9/2013 Nichols, Jr.
2014/0060966 A1 3/2014 Patel et al.
2014/0060968 A1 3/2014 Seman et al.
2014/0224580 A1 * 8/2014 Casebolt ..... A62B 35/0025 182/3
2014/0331459 A1 * 11/2014 Fink ..... A62B 35/0037 24/302
2015/0033458 A1 2/2015 Theisen et al.
2015/0034416 A1 2/2015 Theisen et al.
2015/0060195 A1 3/2015 Sharp et al.
2015/0107059 A1 4/2015 Casebolt
2015/0114753 A1 * 4/2015 Rullo ..... A62B 35/0025 182/9

* cited by examiner

INTEGRAL SAFETY HARNESS CONNECTOR ASSEMBLY

CROSS-REFERENCE TO RELATED APPLICATIONS

This Application claims priority to U.S. Provisional Application Ser. No. 62/173,823, titled "Safety Harness" herewith, filed on Jun. 10, 2015, which is incorporated in its entirety herein by reference.

BACKGROUND

Various occupations place people in precarious positions at relatively dangerous heights thereby creating a need for fall-arresting or fall protection safety apparatus. Among other things, such apparatus usually include a safety line interconnected between a support structure and a person working in proximity to the support structure. The safety line is typically secured to a full-body safety harness worn by the worker. A connector may be used to interconnect the safety line and the full-body safety harness as well as provide a connection for other attachments to the safety harness. The connector must be reliable and able to withstand the forces of a fall. In addition, it is preferred that the connector be user friendly.

For the reasons stated above and for other reasons stated below which will become apparent to those skilled in the art upon reading and understanding the present specification, there is a need in the art for an integral safety harness connector that provides an effective and efficient connection point to a safety harness.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a safety harness connector assembly is provided. The safety harness connector assembly includes a D-ring, a device connector system and a shaft. The D-ring is generally a C-shape including a first end portion, a second end portion and mid-portion. The mid-portion extends between the first end portion and the second end portion. The first end portion has a first D-ring aperture and the second end portion having a second D-ring aperture. Moreover, the first D-ring aperture is aligned with the second D-ring aperture. The device connector system includes at least one device connection aperture that is configured and arranged to couple a device to the safety harness connector assembly. The device connector system has at least one shaft connection aperture. A shaft is received in the first and second D-ring apertures of the D-ring and in the at least one shaft connection aperture of the device connector system to pivotally couple the device connector system to the D-ring.

In another embodiment, another safety harness connector assembly is provided. The safety harness connector assembly includes a D-ring, a shaft and a device connector system. The D-ring has generally a C-shape and includes a first end portion, a second end portion and mid-portion that extends between the first end portion and the second end portion. The first end portion has a first D-ring aperture and the second end portion has a second D-ring aperture. The first D-ring aperture is aligned with the second D-ring aperture. The shaft is received in the first and second D-ring apertures of the D-ring. The device connector system is configured and arranged to couple devices to the safety harness connector assembly. The device connector system includes a base member, a first connector member, a swivel connector and a second connector member. The base member includes at least one shaft connection aperture to receive the shaft therein pivotally coupling the base member to the D-ring. The first connector member is pivotally coupled to the base member. The first connector member has a first device connection passage. The swivel connector is pivotally coupled to the first connector member. The second connector member is pivotally coupled to the swivel connector. The connector member has a second device connection passage.

In further still another, embodiment, another safety harness connector assembly is provided. The safety harness connector assembly includes a device connector system, a base member, a first connector member, a swivel and a second connector member. The device connector system is configured and arranged to couple devices to the safety harness connector assembly. The base member is pivotally coupled to at least one webbing of a safety harness. The first connector member is pivotally coupled to the base member. The first connector member has at least one first device connection passage. The swivel connector is pivotally coupled to the first connector member. The second connector member is pivotally coupled to the swivel connector. The second connector member has at least one second device connection passage.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
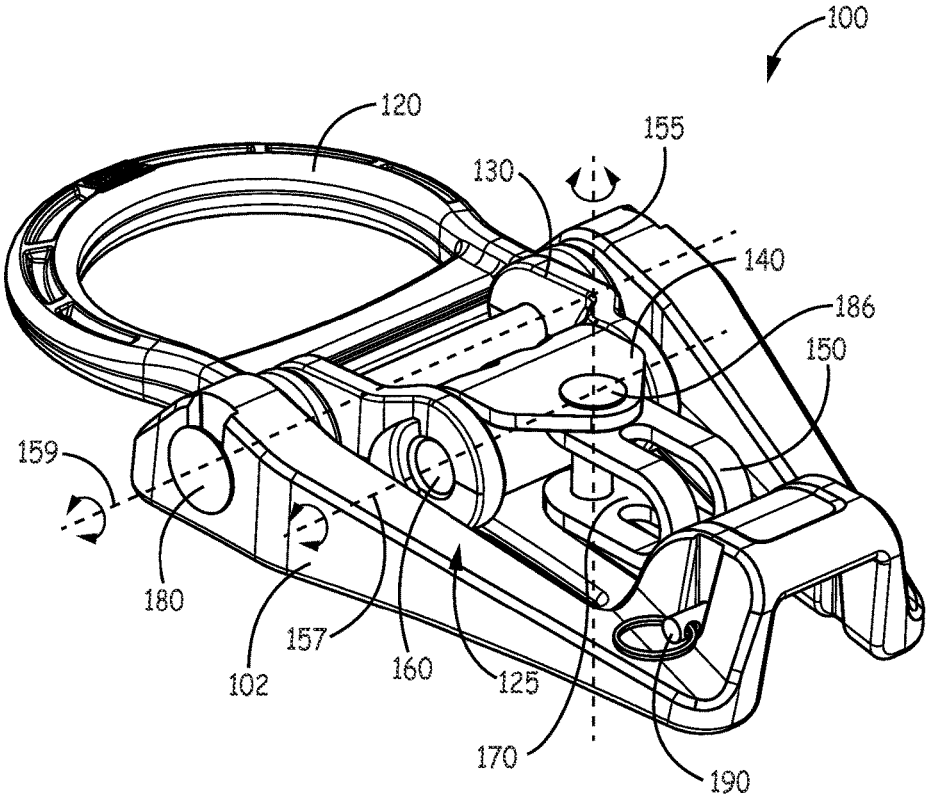
FIG. 1 is a side perspective view of a safety harness connector assembly of one embodiment of the present invention.

Embodiments of the present invention provide an integral safety harness connector assembly. The safety harness connector assembly can be used to couple any type of device to a safety harness such as, but not limited to, a self retracting lifeline (SRL) system. A first embodiment of the safety harness connector assembly 100 is illustrated in FIG. 1. In this embodiment, the safety harness connector assembly 100 includes a D-ring 120, a base dorsal member 102 a device connector system 125. The elements of the safety harness connector assembly 100 are further described in view of the unassembled view provided in FIG. 2. The D ring 120 is generally C shaped having a mid-portion 120*a*, a first end portion 120*b* and a second end portion 120*c*. A brace 124 extends across the D-ring 120 proximate the first end portion 120*b* and the second end portion 120*c*. Each of the first end portion 120*b* and the second end portion 120*c* includes a respective D-ring aperture 121*b* and 121*c*. The D-ring apertures 121*b* and 121*c* are aligned with each other. In the embodiment of the FIG. 2, the first end portion 120*b* includes an extending sleeve portion 122 that is positioned around the ring aperture 121*b*. The sleeve portion 122 includes a biasing receiving slot 123. An arm of a biasing member 182 (a torsion spring in this example embodiment) is received within the biasing receiving slot 123 of the sleeve portion 122 to assert a biasing force on the D-ring 120 to position the D-ring 120 to be at a desired position in relation to the base dorsal member 102.

Figure 3C:
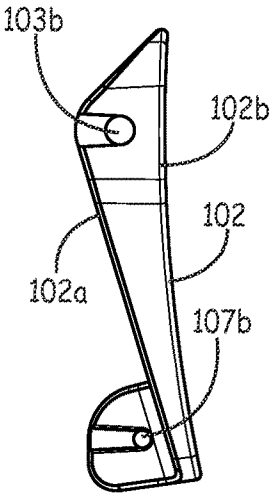
FIG. 3C is a side view of the base dorsal member of FIG. 3A.
Figure 3B:
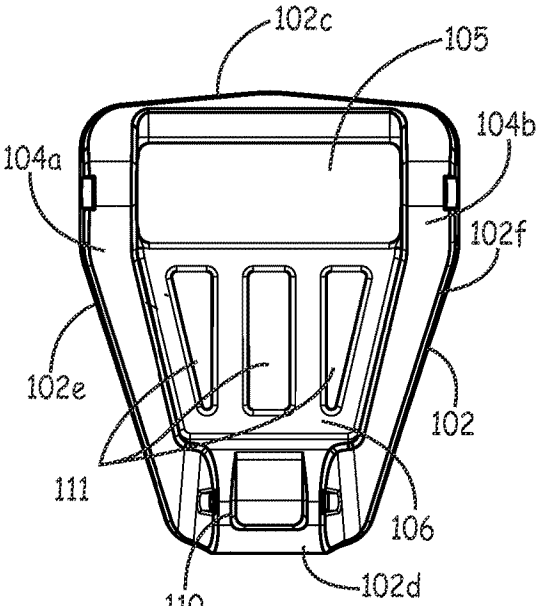
FIG. 3B is a front view of the base dorsal member of FIG. 3A.
Figure 3E:
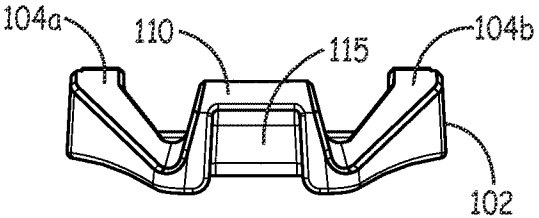
FIG. 3E is a lower view of the base dorsal member of FIG. 3A.
Figure 3A:
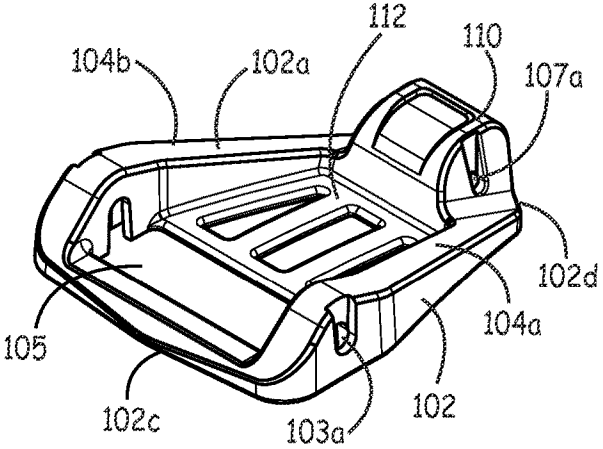
FIG. 3A is a side perspective view of a base dorsal member of one embodiment of the present invention.
Figure 3D:
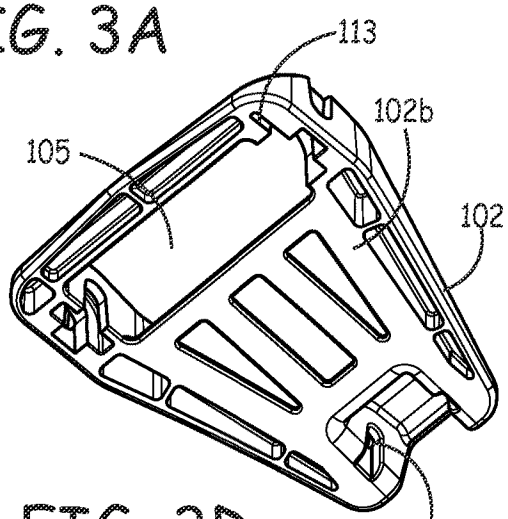
FIG. 3D is a back perspective view of the base dorsal member of FIG. 3A.

The base dorsal member 102 is further shown in FIGS. 3A through 3E. The base dorsal member 102 includes a front side surface 102*a* and a back side surface 102*b*. Further, the base dorsal member 102 includes an upper edge 102*c* and an opposed lower edge 102*d*. Moreover, the base dorsal member 102 includes a first side edge 102*e* and an opposed second side edge 102*f* as illustrated in FIG. 3B. As illustrated in the Figures, the upper edge 102*c* has a greater length than the lower edge 102*d* of the base dorsal member 102. Extending along the length of the first side edge 102*e* is a first side wall 104*a*. The first side wall 104*a* has a height that varies along its length. In the embodiment, the height of the first side wall 104*a* has a low height at the lower edge 102*d*. From the lower edge 102*d*, the height of the first wall 104*a* increases until the height of the first wall 104*a* reaches a maximum height at a select location. The select location of the maximum height is near the upper edge 102*c*. The height of the first wall 104*a* then decreases from the point of maximum height to the upper edge 102*c*. The base dorsal member 102 further includes a second side wall 104*b* that extends along the length of the second side edge 102*f*. In one embodiment, the second side wall 104*b* is a mirror image of the first side wall 104*a*. Positioned between the first and second side walls 104*a* and 104*b* is a mid-plate portion 106. The first side wall 104*a*, the second side wall 104*b* and the mid-plate portion 106 form a holding tray 112 for elements of the safety harness connection assembly 100. The mid-plate portion 106 includes a plurality of shaped slots 111 in this embodiment. Moreover, in this embodiment, the mid-plate portion 106 only extends a portion of a distance between the lower edge 102*d* and the upper edge 102*c* of the base dorsal member 102. A webbing passage 105 is positioned between the mid-plate portion 106 and the upper edge 102*c* of the base dorsal member 102. Each of the first and second side walls 104*a* and 104*b* includes a respective dorsal aperture 103*a* and 103*b*. The respective dorsal apertures 103*a* and 103*b* are aligned with each other and are positioned in the respective first and second side walls 104*a* and 104*b* at a location that is proximate the location of the maximum height of the respective first and second sidewalls 104*a* and 104*b*. Moreover, the respective dorsal apertures 103*a* and 103*b* are positioned on opposite sides of the webbing passage 105. The base dorsal member 102 further includes a biasing arm holding slot 113 which is illustrated in FIG. 3D. The biasing holding member slot 113 holds an arm of biasing member 182.

Figure 2:
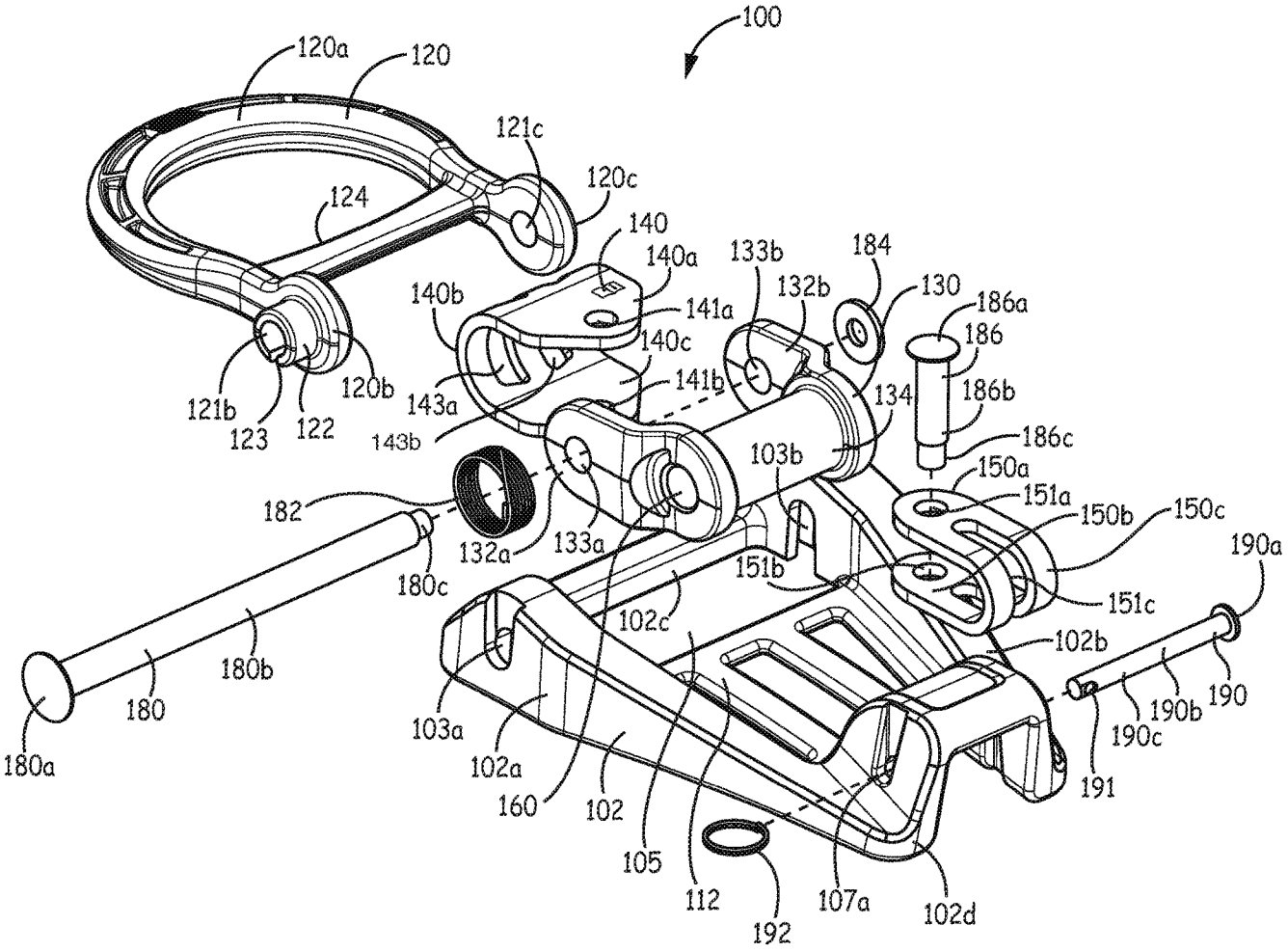
FIG. 2 is an exploded side view of the safety harness connector assembly of FIG. 1.

Proximate the lower edge 102*d* of the base dorsal member 102 in this embodiment is a load attachment member 110. The load attachment member 110 in one embodiment is used to attach a load distribution system 296 of a safety harness 298 (shown generally in FIG. 5D) to the safety harness connection assembly 100. The load attachment member 110 includes a pair of aligned spaced load attachment apertures 107*a* and 107*b* and a cavity 115. A clevis pin 190, as illustrated in FIG. 2, passes through the load attachment apertures 107*a* and 107*b* to couple a portion the load distribution system 296 of the safety harness 298, received in the cavity, to the safety harness connection assembly 100. The clevis pin 190, in this example embodiment, includes a head 190*a*, a pin mid-portion 190*b* and an end portion 190*c*. In the end portion 190*c* is a ring aperture 191 that is designed to receive a split ring 192 to lock the clevis pin 190 to the load attachment member 110.

Figure 5A:
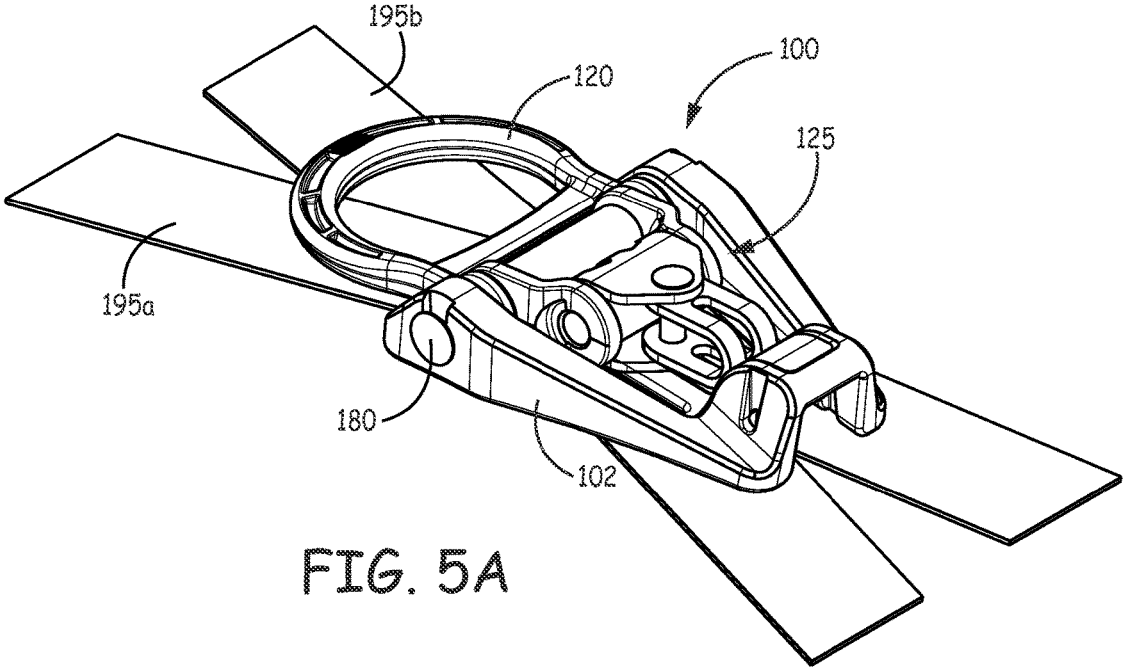
FIG. 5A is a side perspective view of the safety harness connector assembly of FIG. 1 coupled to webbings of a safety harness in one embodiment of the present invention.
Figure 5B:
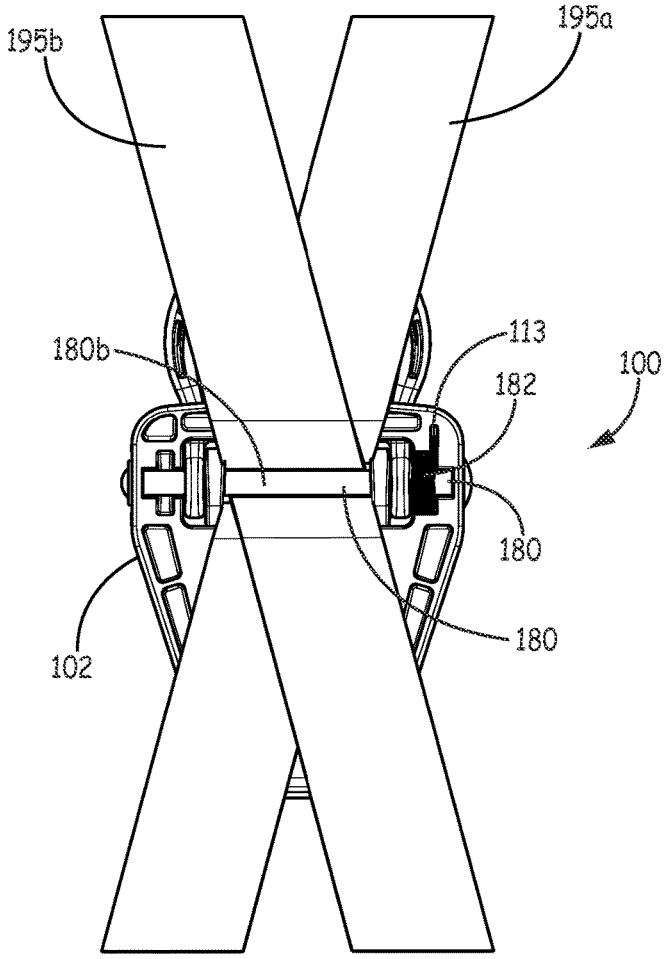
FIG. 5B is a back view of the safety harness connector assembly of FIG. 1 coupled to webbings of a safety harness in one embodiment of the present invention.

Referring to FIG. 2, the D-ring 120 is coupled to the base dorsal member 102 via dorsal rivet 180. In particular, the dorsal rivet 180 includes a head 180*a*, a mid-shaft portion 180*b* and end portion 180*c*. The end portion 180*c* of the dorsal rivet 180 has a smaller diameter than the mid-shaft portion 180*b* in this embodiment. The end portion 180*c* is connected to connecting nut 184. The mid-shaft portion 180*b* of the dorsal rivet 180 is received in the dorsal aperture 103*a*, D-ring aperture 121*b*, D-ring aperture 121*c* and dorsal aperture 103*b* to pivotally couple the D-ring 120 to the base dorsal member 102. The dorsal rivet 180 is also used to attach the safety harness connector assembly 100 to webbing of a safety harness. Referring to FIGS. 5A through 5B illustrations of the harness connector assembly 100 coupled to webbings 195*a* and 195*b* that are part of a safety harness system is shown. Webbings 195*a* and 195*b* would typically run along a back of a user from the user's shoulders to a belt webbing (not shown). In the embodiment shown, the webbings 195*a* and 195*b* cross. The harness connector assembly 100 is coupled at a point where the webbing 195*a* and 195*b* cross. In particular, as illustrated in the back view of FIG. 5B, the webbings 195*a* and 195*b* are routed around dorsal rivet 180 in the webbing passage 105 of the base dorsal member 102. In one embodiment, the harness connector assembly 100 is mounted on the webbings 195*a* and 195*b* by first placing the crossing webbings 195*a* and 195*b* in the webbing passage 105 of the base dorsal member 102 and then inserting the dorsal rivet 180 through dorsal apertures 103*a* and 103*b* of the base dorsal member 102. In addition, as illustrated in FIG. 5B the biasing member 182 is positioned around the dorsal rivet 180 with one of its arms received in the biasing holding member slot 113 of the base dorsal member 102. As discussed above, another arm of the biasing member 182 is received within the biasing receiving slot 123 of the sleeve portion 122 to assert a biasing force on the D-ring 120 to cause the D-ring to be at a desired position in relation to the base dorsal member 102.

Figure 4A:
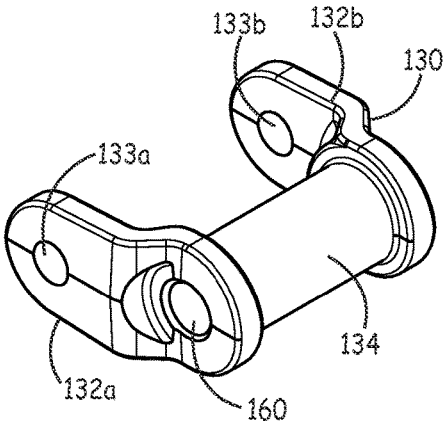
FIG. 4A is a first side view of a first connector member of a device connector system of the safety harness connector assembly of FIG. 1.
Figure 4B:
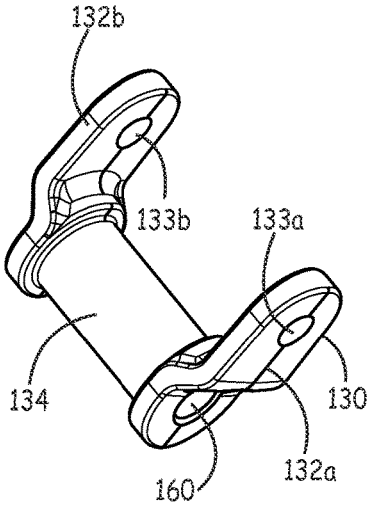
FIG. 4B is a second side view of a first connector member of a device connector system of the safety harness connector assembly of FIG. 1.

The device connector system 125 includes a first connector member 130, a swivel connector 140 and a second connector member 150. The first connector member 130 is shown in detail in FIGS. 4A and 4B. The first connector member 130 includes a first arm 132*a* and a second arm 132*b* that extend out on opposite ends of a mounting rod 134. The mounting rod 134 includes a central mounting passage 160 that passes though the entire length of the mounting rod 134. Each of the first arm and the second arm 132*a* and 132*b* includes a respective rivet passage 133*a* and 133*b*. The respective rivet passages 133*a* and 133*b* are positioned proximate terminal ends of each respective arm 132*a* and 132*b*. Moreover the rivet passages 133*a* and 133*b* are aligned. The first connector member 130 is pivotally coupled to the base dorsal member 102 via the dorsal rivet 180 received in the aligned rivet passages 133*a* and 133*b* of the first connector member 130. Referring back to FIG. 2, the swivel connector 140 of the device connector system 125 is further described. The swivel connector 140 is generally C-shaped having a swivel first end 140*a*, a swivel second end 140*c* and a curved swivel mid-portion 140*b*. The swivel mid-portion 140*b* has a width that is generally equal to the width of the mounting rod 134 of the first connector member 130. Moreover, the curve of the swivel mid-portion 140*b* of the swivel connector 140 matches generally the radius of curvature of the mounting rod 134 of the first connector member 130. The swivel mid-portion 140*b* of the swivel connector 140, in this embodiment, includes slots 143*a* and 143*b*. Moreover, swivel mid-portion 140*b* of the swivel connector 140 is positioned around the mounting rod 134 of the first connector member 130. Each of the respective swivel first and second ends 140*a* and 140*c* of the swivel connector 140 generally taper to a terminal point. Moreover, each of the swivel first and second ends 140*a* and 140*c* of the swivel connector 140 include pivot connection apertures 141*a* and 141*b*. The pivot connection apertures 141*a* and 141*b* of the swivel connector 140 are aligned with each other.

As further illustrated in FIG. 2, the second connector member 150 is also generally C-shaped. The second connector member 150 has a first end portion 150*a*, a second end portion 150*b* and a curved mid-portion 150*c*. The first and second end portions 150*a* and 150*b* terminate in a rounded configuration. The curved mid-portion 150*c*, in this embodiment, includes a slot 151*c*. Each of the first end portion 150*a* and the second end portion 150*b* include a respective first and second connector aperture 151*a* and 151*b*.

Figure 5C:
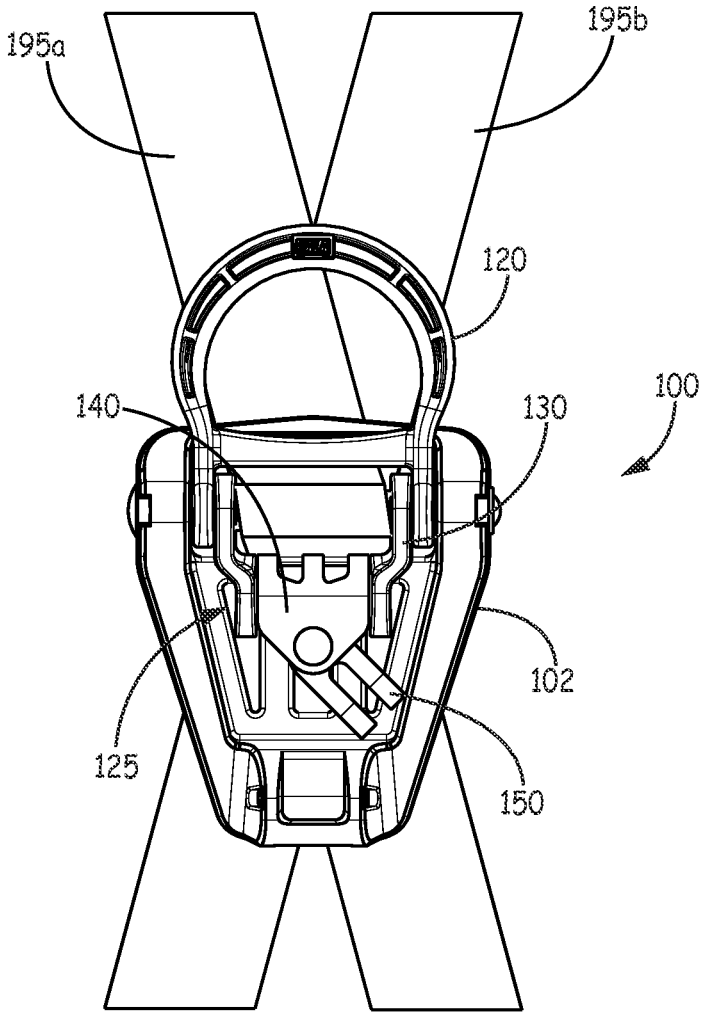
FIG. 5C is a front view of the safety harness connector assembly of FIG. 1 coupled to webbings of a safety harness in one embodiment of the present invention.
Figure 5D:
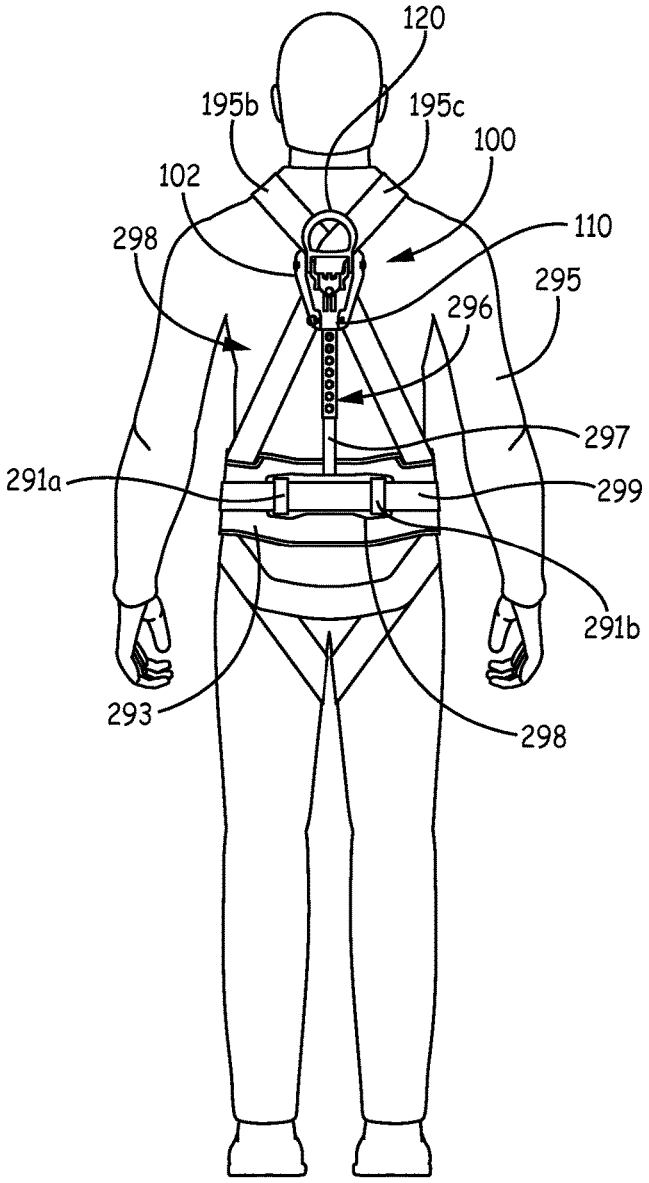
FIG. 5D is a front view of the safety harness connector assembly of FIG. 1 coupled to a safety harness in one embodiment of the present invention.

The device connector system 125 is coupled to the base dorsal member 102 of the safety harness connector assembly 100 via dorsal rivet 180 received in the rivet passages 133*a* and 133*b* of the first connector member 130. In the example embodiment shown in FIG. 2, a connector washer 184 is received on the end portion 180*c* of the dorsal rivet 180. Washer 184 is used to provide a surface for a rivet heading operation. The washer 184 further sets the effective length of the rivet by compressing against a rivet shoulder. The swivel mid-portion 140*b* of the swivel connector 140 is received around the mounting rod 134 of the first connector member 130. A connector rivet 186 that includes a head 186*a*, a terminal end portion 186*c* and a mid-shaft portion 186*b* couples the swivel connector 140 to the first connector member 130. As illustrated in FIG. 2, the terminal end portion 186*c* of the connector rivet 186 has a smaller diameter than the mid-shaft portion 186*b* in this example embodiment. The connector rivet 186 received in the pivot connection aperture 141*a* and 141*b* of the swivel connector 140 pivotally couples the swivel connector 140 to the first connector member 130. The swivel connector 140 pivotally rotates about the mounting rod 134 of the first connector member 130. The connector rivet 186 further pivotally couples the second connector member 150 to the swivel connector 140. In particular, the connector rivet 186 is received in the first and second connector apertures 151*a* and 151*b* of the second connecter member 150 to pivotally couple the connector member 150 to the swivel connector 140. The pivot connections between each of the first connector member 130 and the base dorsal member 102, the first connector member 130 and the swivel connector 140 and the swivel connector 140 and the second connector member 150 allow the device connector 125 to be positioned in different configurations for attachment of different types of devices. In FIG. 1, the device connector system 125 is shown being positioned in the holding tray 112 of the base dorsal member 102. Moreover, FIG. 5C illustrates the second connection member 150 being pivoted in relation to the swivel connector 140. In addition, in the example embodiment as illustrated in FIG. 1, a pivot axis 155 of the second connector member 150 about connector rivet 186 is generally in a perpendicular orientation in relation to a pivot axis 157 of the swivel connector 140 about the mounting rod 134 and a pivot axis 159 of the first connector member 130 about dorsal rivet 180. In addition, FIG. 5D illustrates the safety harness connector assembly 100 coupled to a safety harness 298 donned by a user 295. In particular, the safety harness connector assembly 100 is coupled to webbings 195*a* and 195*b* of the safety harness 298. Also illustrated in FIG. 5D is a load distribution system 296 that is coupled to the load attachment member 110 of the safety harness connector member 130. The load distribution system 297 transfers a load on the safety harness connector assembly 100 via an adjustable load bar 297 to a hip plate 298 that is coupled to a hip pad 293 of the safety harness 298. As further illustrated, a hip webbing 299 of the safety harness 298 is routed through webbing holding members 291*a* and 291*b* in the hip plate 298.

Figure 6A:
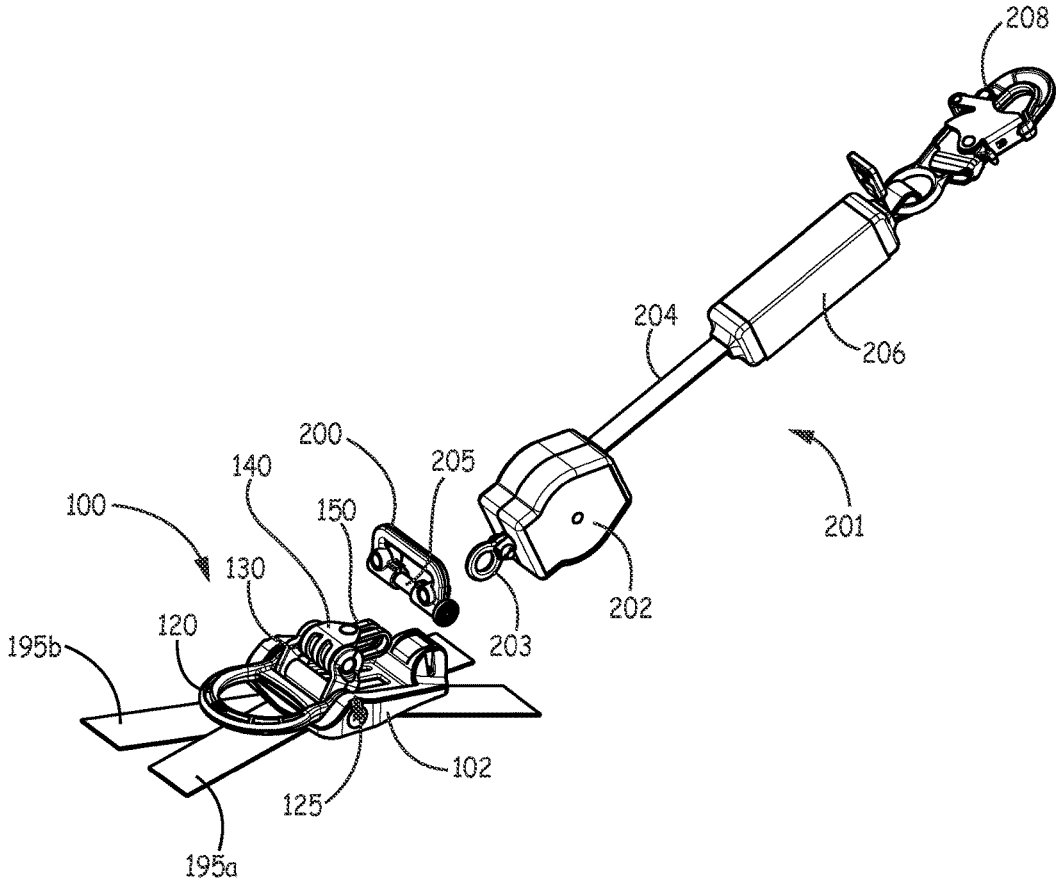
FIG. 6A is a side perspective view of the device connector system of the safety harness connector assembly of FIG. 1 in a configuration to couple a self retracting lifeline system to safety harness webbings in one embodiment of the present invention.
Figure 6B:
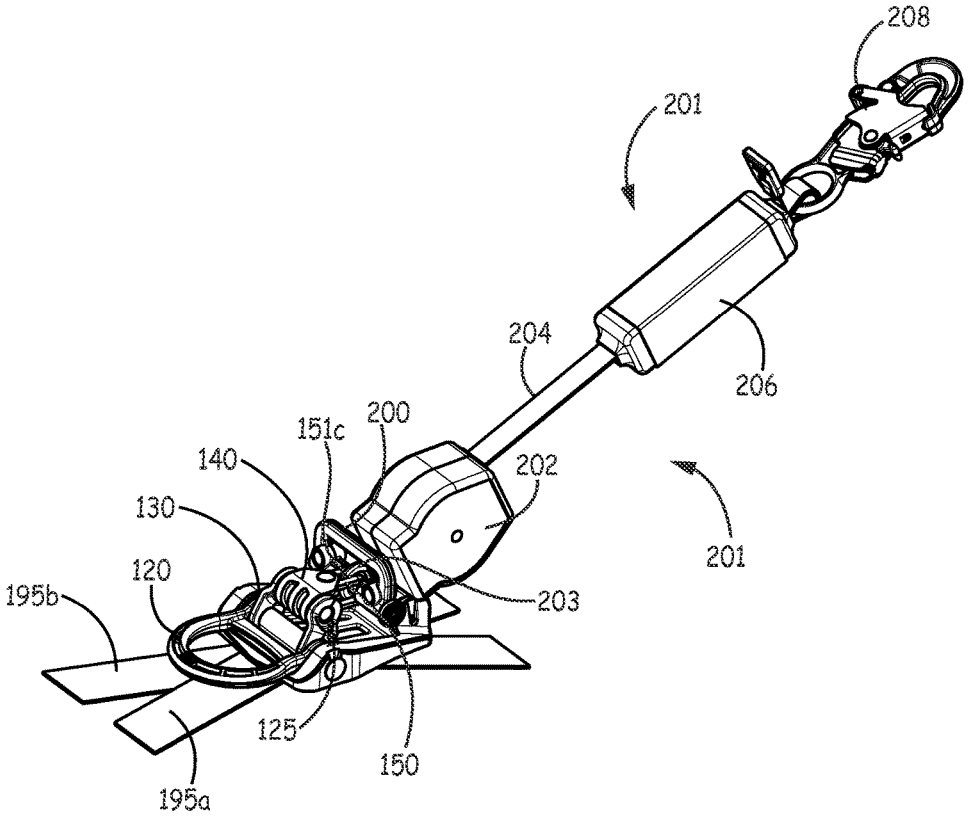
FIG. 6B is a side perspective view of the device connector system of the safety harness connector assembly of FIG. 1 coupling the self retracting lifeline system of FIG. 6A to the safety harness webbings.

Referring to FIG. 6A an illustration of the device connector system 125 positioned in a configuration to receive a device connector 200 is shown. In this example, the connector 200 is a self retracting lifeline (SRL) connector. FIG. 6A further illustrates a SRL system 201 that includes a SRL 202, a lifeline 204, an energy absorbing system 206 and a support structure connector 208. A connecting ring 203 is coupled to a housing of the SRL 202. FIG. 6B illustrates the SRL system 201 coupled to the safety harness connector assembly 100. In this example, the connecting ring 203 receives a mounting rod portion 205 of the SRL connector 200. The mounting rod portion 205 is also received within the second connection passage 170 of the second connection member 150 to pivotally couple the SRL system 201 to the webbing 195*a* and 195*b* of a safety harness. FIG. 6B further illustrates that in this configuration, the connecting ring 203 is received in the slot 151*c* of the second connection member 150.

Figure 7A:
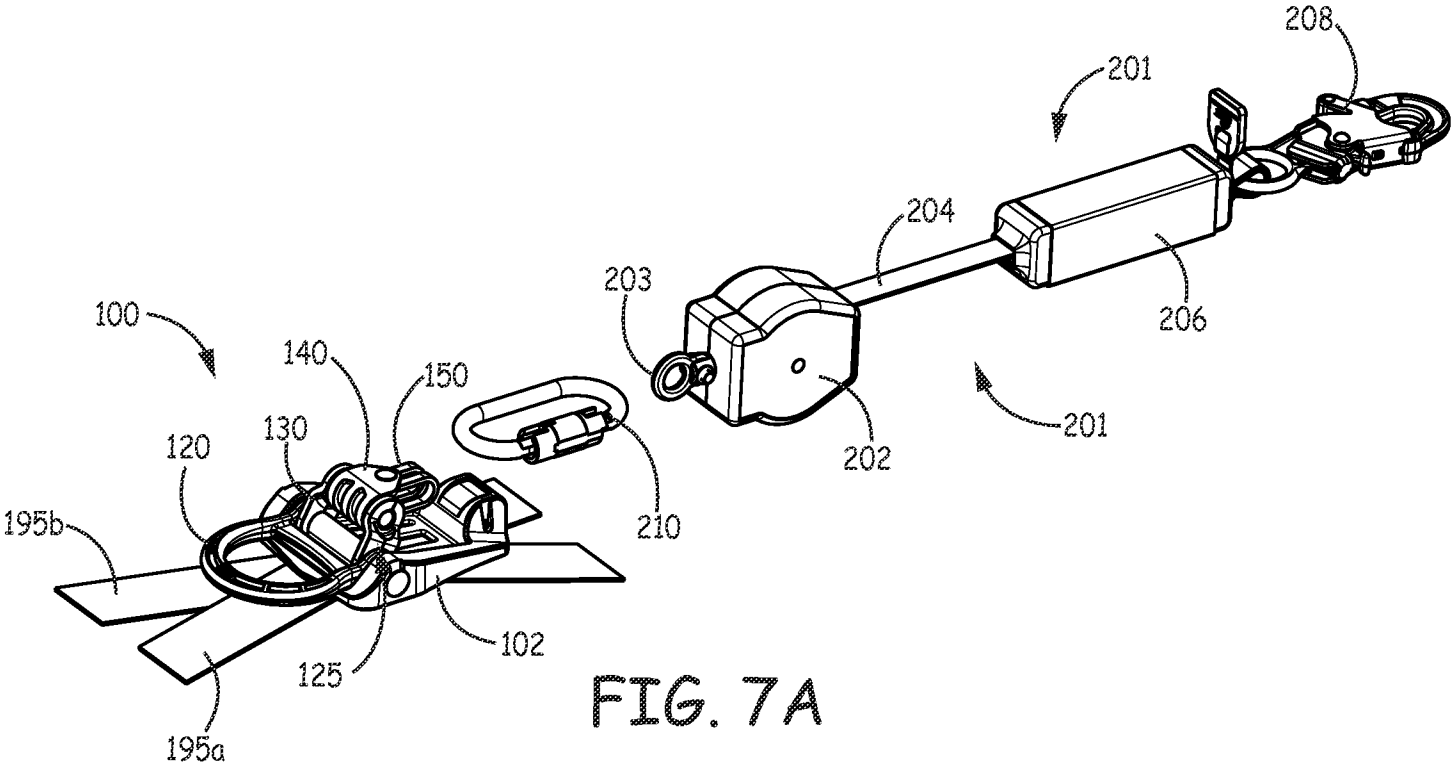
FIG. 7A is a side perspective view of the device connector system of the safety harness connector assembly of FIG. 1 in a configuration to couple a self retracting lifeline system to safety harness webbings with a different SRL connector in one embodiment of the present invention.
Figure 7B:
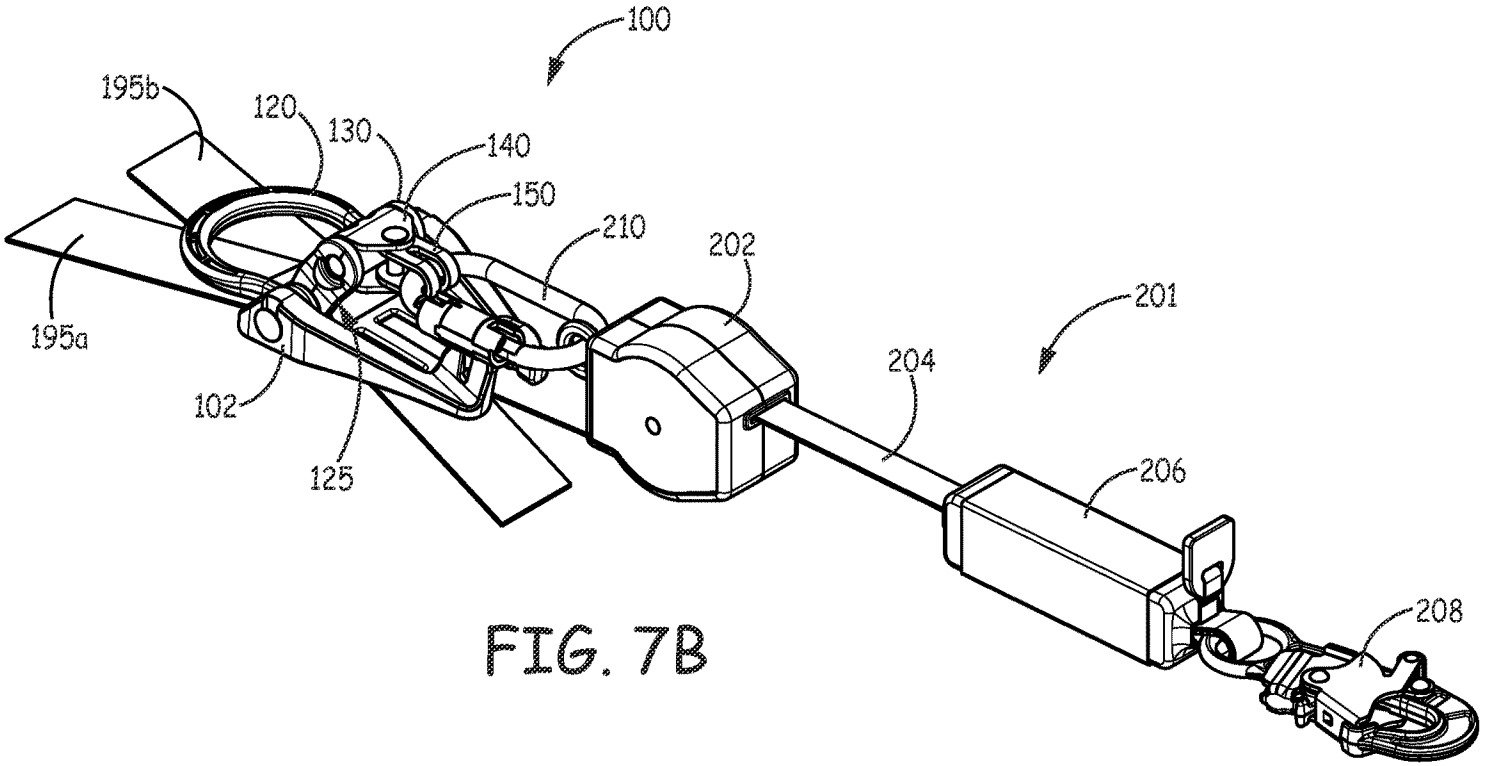
FIG. 7B is a side perspective view of the device connector system of the safety harness connector assembly of FIG. 1 coupling the self retracting lifeline system of FIG. 7A to the safety harness webbings.

FIG. 7A is an illustration of the device connector system 125 positioned in a configuration to receive a different SRL connector 210. In this example, the SRL connector 210 is a carabiner. FIG. 6B illustrates the SRL system 201 coupled to the safety harness connector assembly 100 via carabiner connector 210. In this example, the connecting ring 203 receives a portion of the carabiner connector 210 while another portion of the carabiner connector 210 is received within the second connection passage 170 of the second connection member 150 to pivotally couple the SRL system 201 to the webbing 195*a* and 195*b* of a safety harness.

Figure 8A:
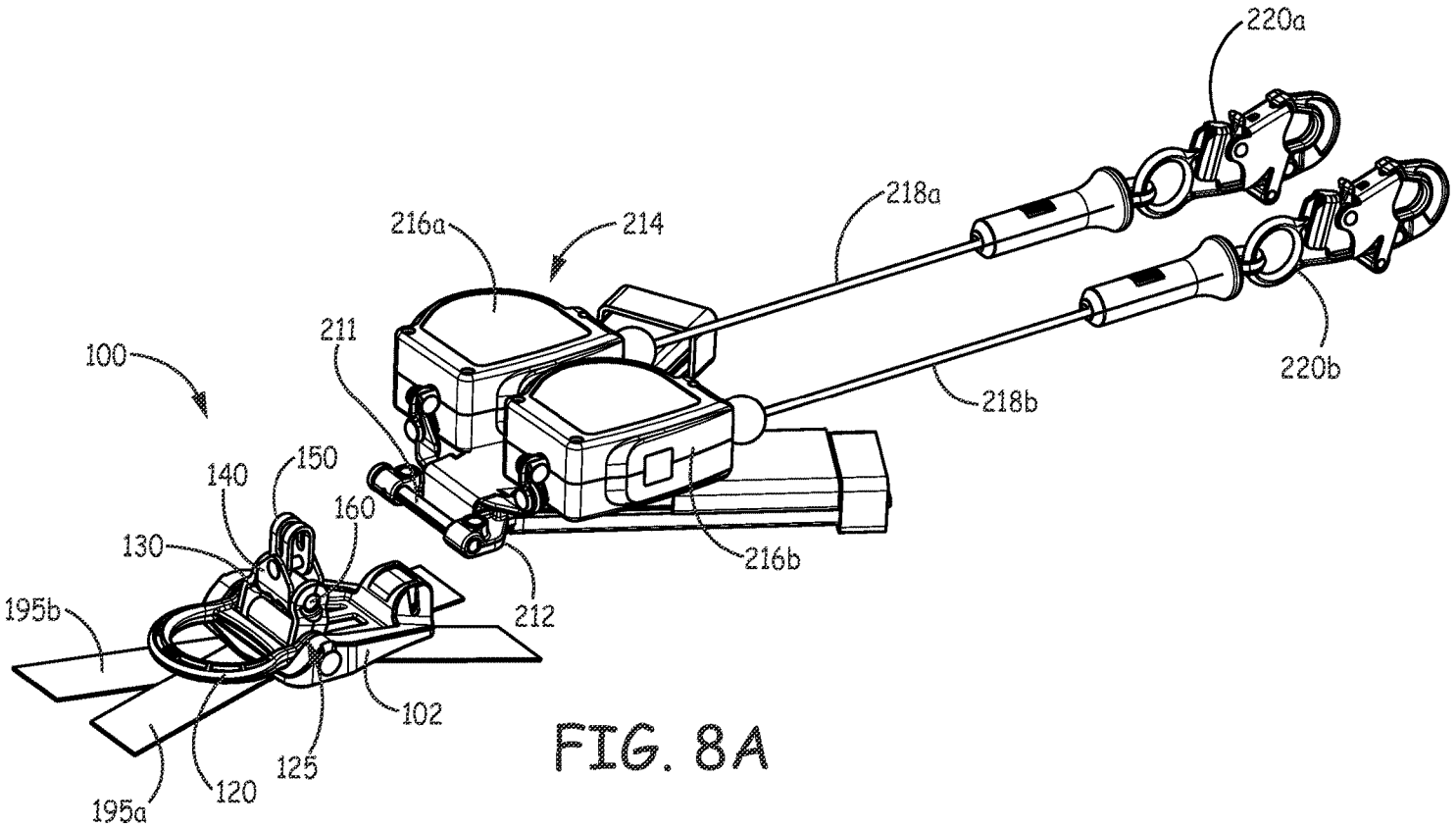
FIG. 8A is a side perspective view of the device connector system of the safety harness connector assembly of FIG. 1 in a configuration to couple a self retracting lifeline system to safety harness webbings with yet another type of SRL connector in one embodiment of the present invention.
Figure 8B:
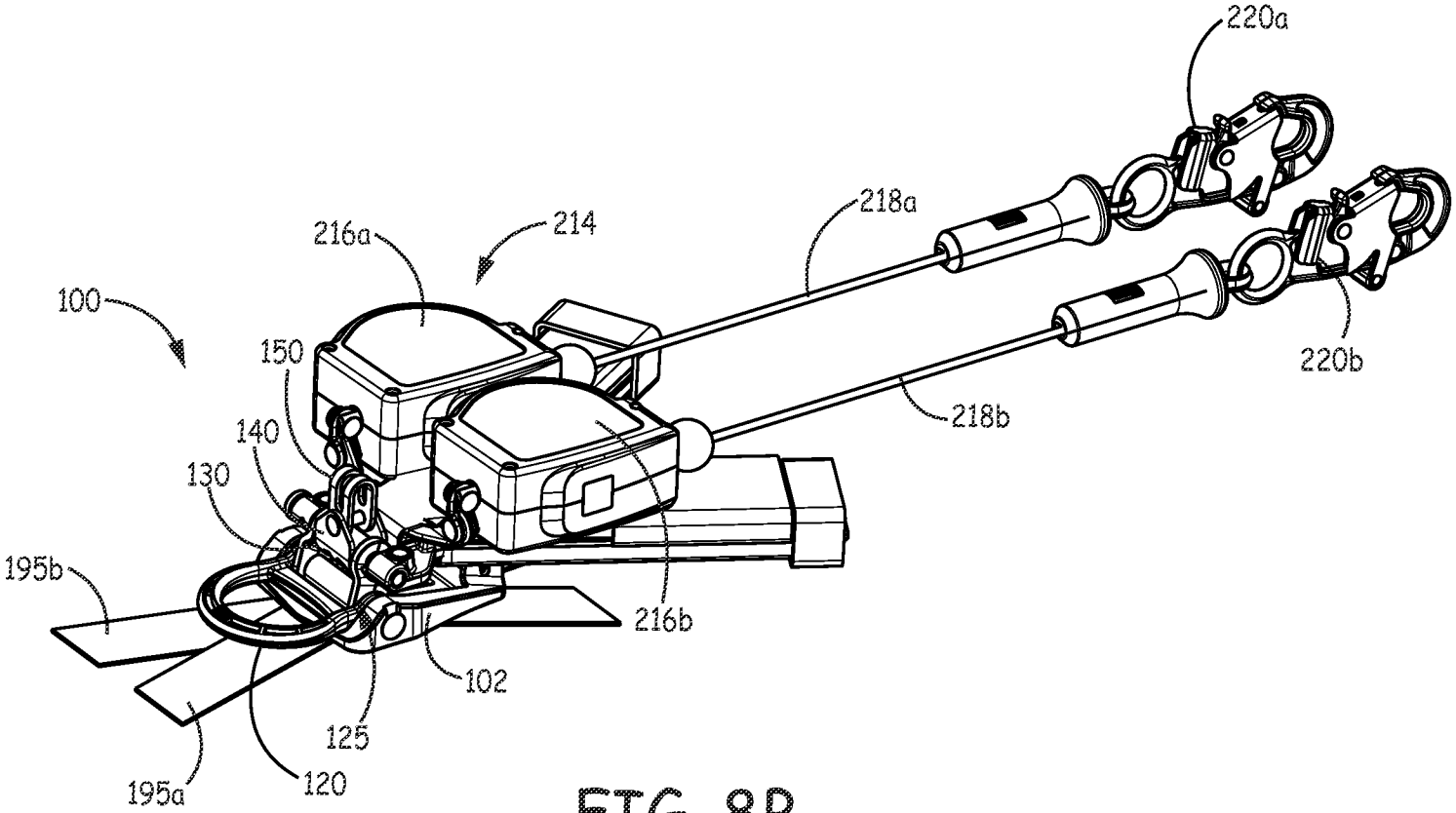
FIG. 8B is a side perspective view of the device connector system of the safety harness connector assembly of FIG. 1 coupling the self retracting lifeline system of FIG. 8A to the safety harness webbings.

Referring to FIG. 8A, an illustration of the device connector system 125 positioned in a configuration to receive a connector 212 is shown. In this example, the connector 212 is a SRL connector that is designed to attach a dual SRL system 214 to the safety harness connection assembly 100. FIG. 8A illustrates the dual SRL system 214 includes a pair of SRLs 216*a* and 216*b*, lifelines 218*a* and 218*b* and a support structure connectors 220*a* and 220*b*. FIG. 8B illustrates the dual SRL system 214 coupled to the safety harness connector assembly 100. In this example, a mounting rod portion 211 (illustrated in FIG. 8A) of SRL connector 212 is received within the first connector passage 160 of the first connector member 130 to pivotally couple the dual SRL system 214 to the webbing 195*a* and 195*b* of a safety harness. Hence, as illustrated and described, the device connector system 125 of the safety harness connector assembly 100 can be positioned in different configurations and has different connection points to enable the device connector system 125 to couple different type of devices and connectors to the webbings 195*a* and 195*b* of the safety harness.

Figure 9B:
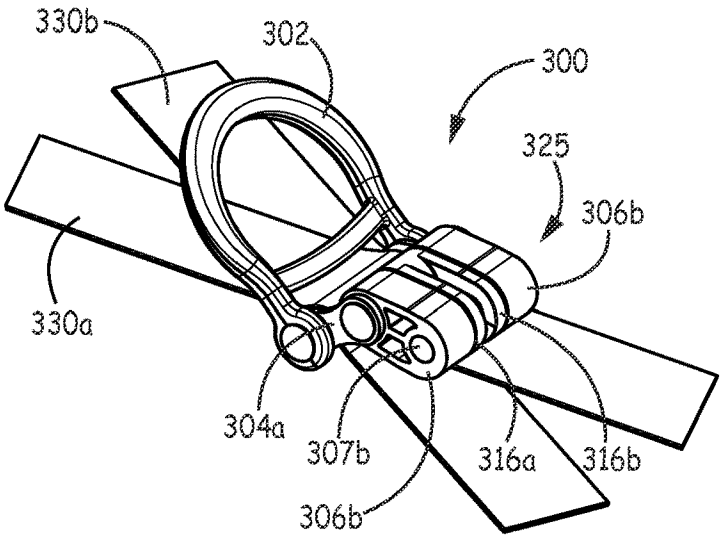
FIG. 9B is a side perspective view of the safety harness connector assembly of FIG. 9A with its device connector system in a different configuration.
Figure 9A:
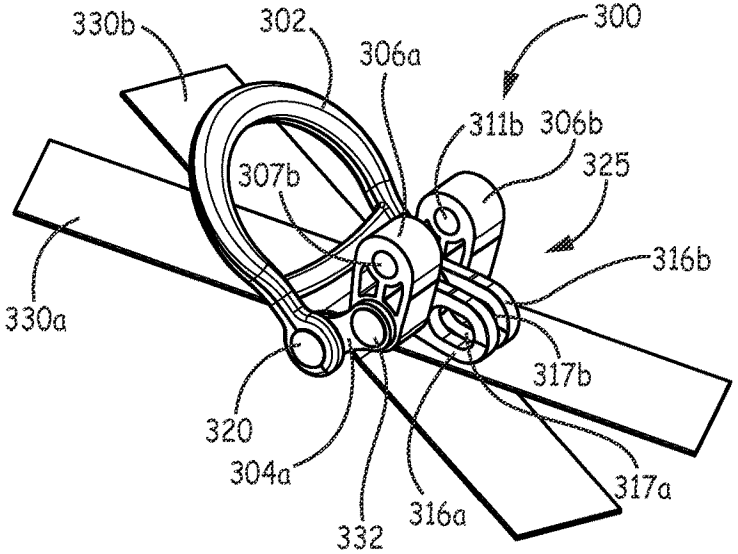
FIG. 9A is a side perspective view of a safety harness connector assembly of another embodiment of the present invention.
Figure 10:
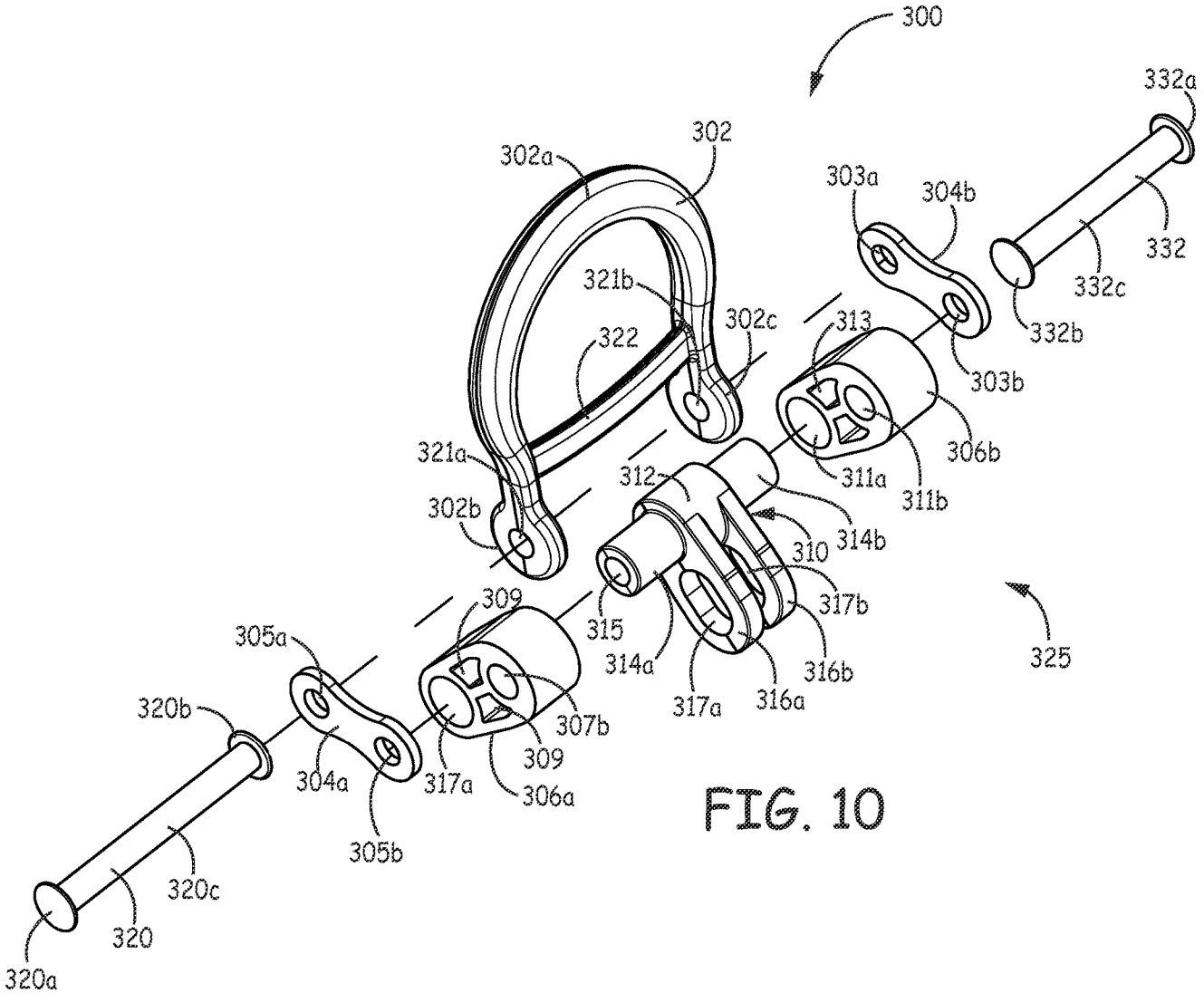
FIG. 10 is an exploded side view of the safety harness connector assembly of FIG. 9A.

Another embodiment of a safety harness connector assembly 300 is illustrated in FIGS. 9A through 14. FIGS. 9A and 9B illustrate the device connector system 325 of the safety harness connection assembly 300 in different configurations to couple different devices to the webbings 330*a* and 330*b* of a safety harness (not shown). FIG. 10 illustrates an unassembled view of the safety harness connection assembly 300. The safety harness connection assembly 300 includes a D-ring 302. The D-ring 302 is generally C-shaped having a mid-portion 302*a*, a first end portion 302*b* and a second end portion 302*c*. A brace 322 extends across the D-ring 302 proximate the first end portion 302*b* and the second end portion 302*c*. Each of the first end portion 302*b* and the second end portion 302*c* includes a respective D-ring aperture 321*a* and 321*b*. The D-ring apertures 321*a* and 321*b* are aligned with each other.

The safety harness connector assembly 300 further includes a device connector system 325. The device connector system 325 includes a base member 310, a first connector member 306*a*, a second connector member 306*b*, a first link 304*a*, a second link 304*b*, dorsal rivet 320 and connection rivet 332. The base member 310 includes a mid-barrel portion 312. Extending on opposite ends of the mid-barrel portion 312 are respective first and second tube portions 314*a* and 314*b*. The first and second tube portions 314*a* and 314*b* have a smaller diameter than a diameter of the mid-barrel portion 312. A central connector rivet aperture 315 extends through the first tube portion 314*a*, the mid-barrel portion 312 and the second tube portion 314*b*. The base member further include first and second connecting arms 316*a* and 316*b* that extend from a surface of the mid-barrel portion 312 in a spaced parallel fashion. The first and second connecting arms 316*a* and 316*b* terminate in rounded edges and each connecting arm 316*a* and 316*b* include a respective device connection passage 317*a* and 317*b* that are aligned with each other. In the example embodiment, the first connector member 306*a* is a mirror image of the second connector member 306*b*. The first and second connector members 306*a* and 306*b* extend a select length terminating in rounded edges. The first connector member 306*a* includes a first aperture 307*a* that is configured to receive the first tube portion 314*a* of the base member 310. Similarly, the second connector member 306*b* includes a first aperture 311*a* that is configured to receive the second tube portion 314*b* of the base member 310. The first connector member 306*a* further includes a connection aperture 307*b* and the second connector member 306*b* further includes a connection aperture 311*b*. In the example embodiment, the first connector member 306*a* and the second connector member 306*b* includes respective voids 309 and 313 for reduction of weight purposes. The device connector system 325 further includes a first link 304*a* and a second link 304*b*. The first link 304*a* is a mirror image of the second link 304*b*. The first and second links 304*a* and 304*b* both extend a select length terminating in rounded edges. The first link 304*a* has a first link first aperture 305*a* near a first end of the first link 304*a* and a first link second aperture 305*b* near a second end of the first link 304*a*. The second link 304*b* has a second link first aperture 303*a* near a first end of the second link 304*b* and a second link second aperture 303*b* near a second end of the second link 304*b*.

A dorsal rivet 320 having a mid-shaft portion 320*c* and ends that terminate in a first head 320*a* and a second head 320*b* is received in the first link first aperture 305*a* of the first link 304*a*, in the D-ring apertures 321*a* and 321*b* of the D-ring 302 and in the second link first aperture 303*a* of the second link 304*b* to pivotally couple the first and second links 304*a* and 304*b* to the D-ring 302. A connection rivet 332 having a mid-shaft portion 332*c* and ends that terminate in a first head 332*a* and a second head 332*b* is received in first link second aperture 305*b* of the first link 304*a*, the first aperture 307*a* of the first connector member 306*a*, the central connector rivet aperture 315 of the base member 310, the first aperture 311*a* of the second connector member 306*b* and the second link second aperture 303*b* of the second link 304*b* to pivotally couple the remaining portion of the device connector system 325 to the D-ring 302. The pivot connections in this configuration allow for different positioning of the device connector system 325. For example, FIG. 9A illustrates one possible configuration of the device connector system 325 with the connection aperture 307*b* of the first connector member 306*a* being aligned with the connection aperture 311*b* of the second connector member 306*b* while device connection passages 317*a* and 317*b* of the respective first and second connecting arms 316*a* and 316*b* are aligned with each other. In the configuration of FIG. 9B all the apertures 307*b*, 311*b* and passages 317*a* and 317*b* are aligned.

Figure 11:
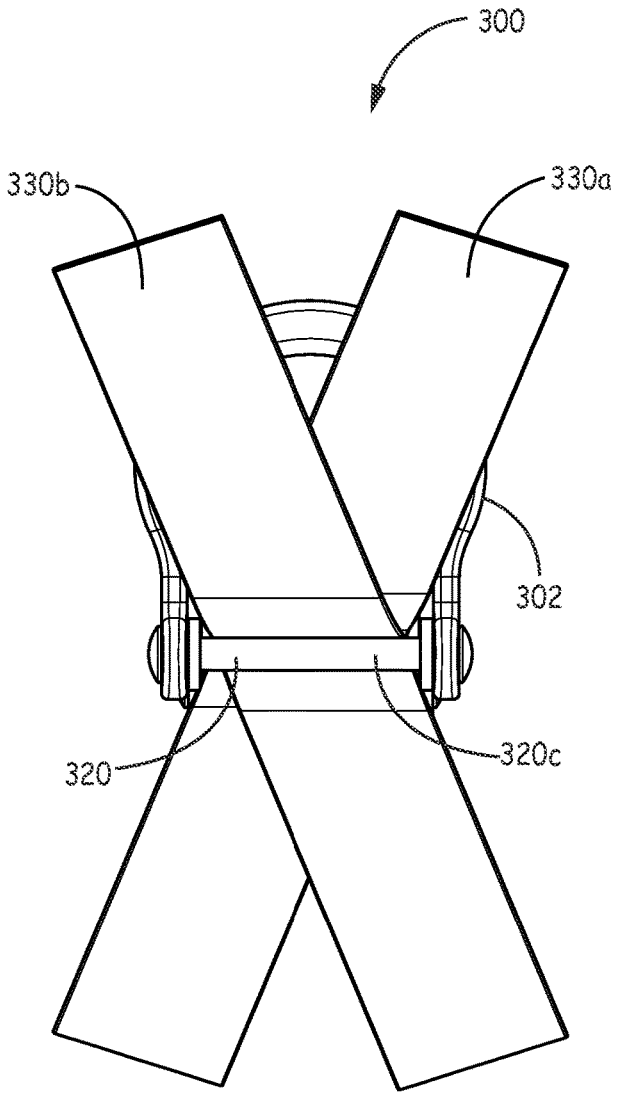
FIG. 11 is a back view of the safety harness connector assembly of FIG. 9A coupled to webbings of a safety harness.
Figure 12:
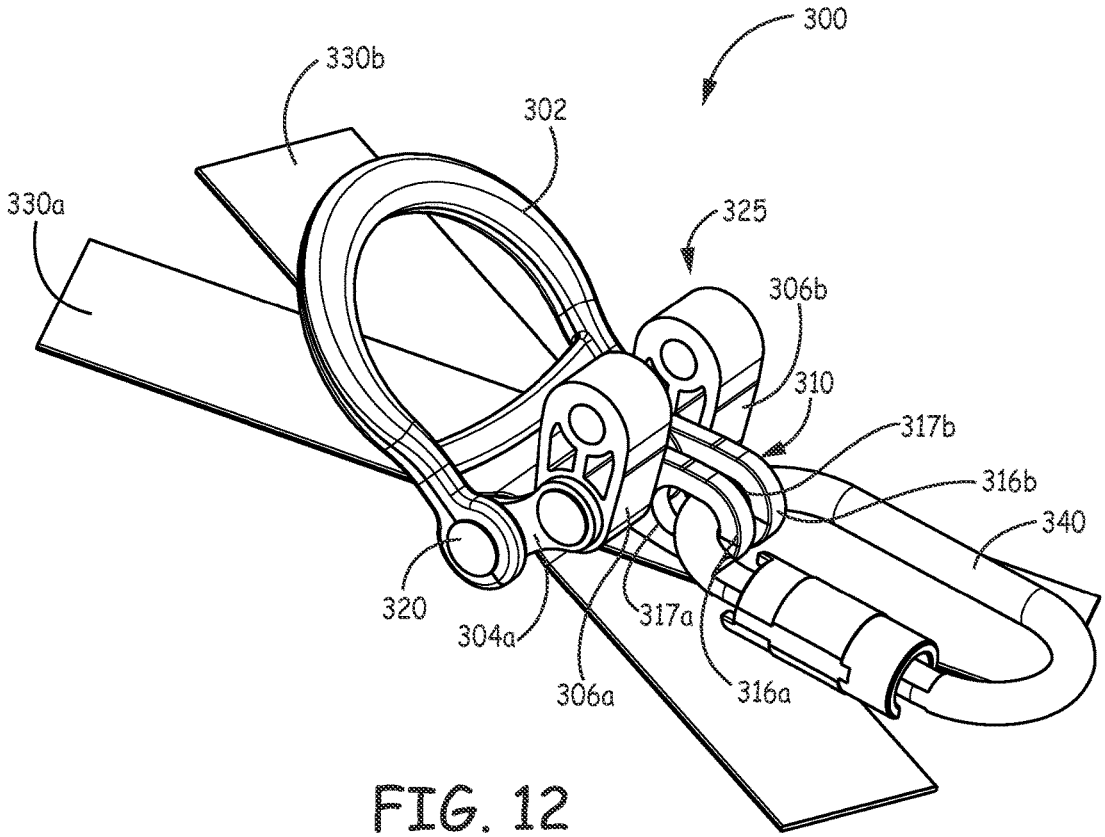
FIG. 12 is a side perspective view of the safety harness connector assembly of FIG. 9A with a carabiner attached.
Figure 13:
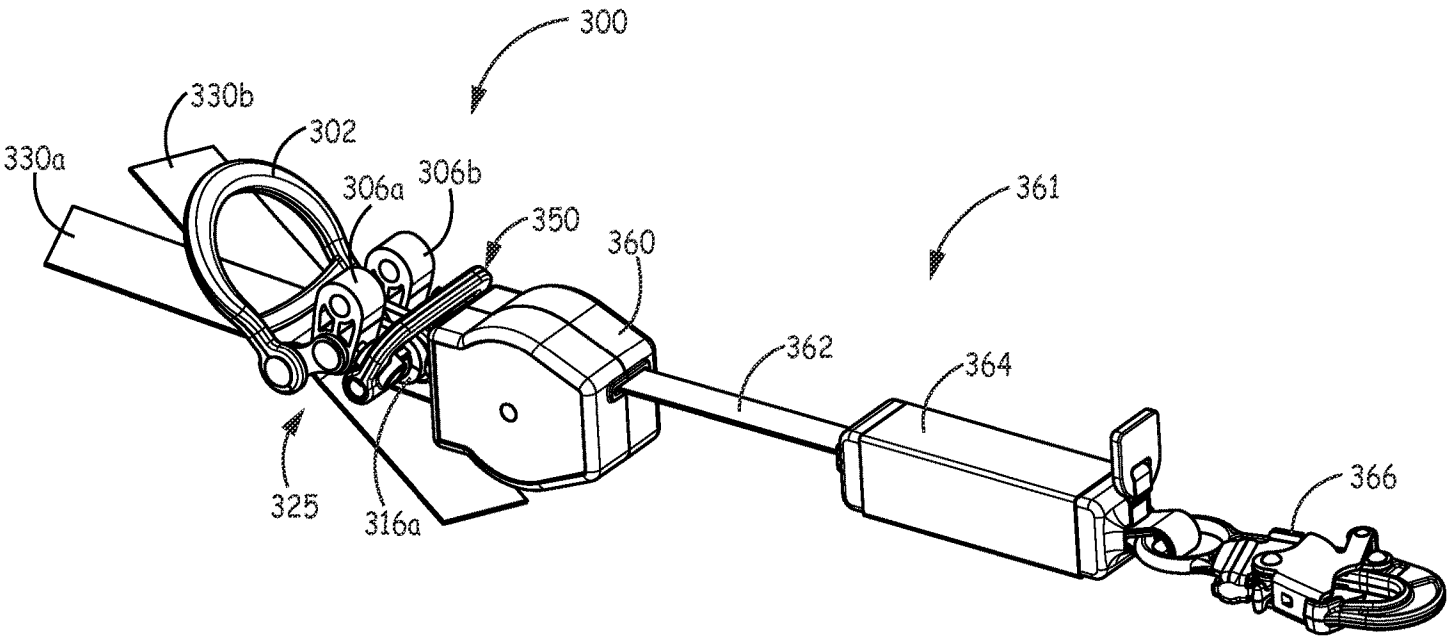
FIG. 13 is a side perspective view of the safety harness connector assembly of FIG. 9A with a SRL system attached.
Figure 14:
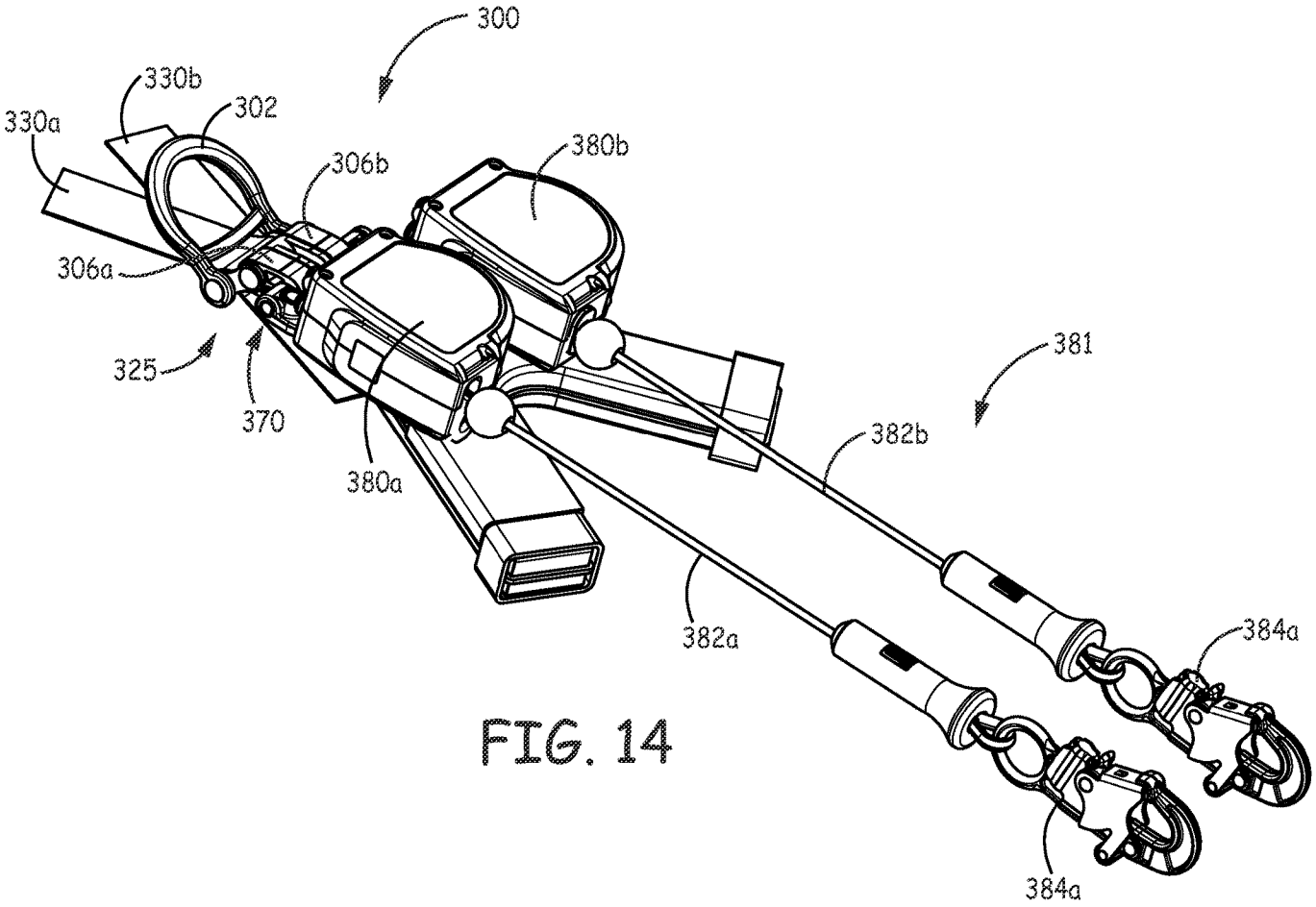
FIG. 14 is a side perspective view of the safety harness connector assembly of FIG. 9A with a different SRL system attached.

FIG. 11 illustrates the webbings 330*a* and 330*b* at their crossing are positioned between the mid-shaft portion 320*c* of the dorsal rivet 320 and the D-ring 302 and the device connector system 325 used to couple the webbings 330*a* and 330*b* of the safety harness to the safety harness connection assembly 300. FIG. 12 illustrates a carabiner 340 being coupled to the device connector system 325 via receiving the carabiner in the device connection passages 317*a* and 317*b* of the respective first and second connecting arms 316*a* and 316*b*. Any type of device could then in turn be coupled to the carabiner 340. FIG. 13 illustrates a SRL system 361 coupled to webbing 330*a* and 330*b* via the device connector system 325. A SRL connector 350 is received in the device connection passages 317*a* and 317*b* of the respective first and second connecting arms 316*a* and 316*b* of the device connector system 325. The SRL system 361 in this example includes a SRL 360, lifeline 362, energy absorber 364 and a support structure connector 366. Referring to FIG. 14, an illustration of the device connector system 325 coupling a dual SRL system 381 to the webbings 330*a* and 330*b* of a safety harness is shown. In this example embodiment, a SRL connector is received in all the aligned apertures 307*b*, 311*b* and passages 317*a* and 317*b* in the respective first and second connector members 306*a* and 306*b* and first and second connecting arms 316*a* and 316*b*. The SRL system 381 includes a pair of SRLs 380*a* and 380*b* and their respective life lines 382*a* and 382*b* and support structure connectors 384*a* and 384*b*.

Another embodiment of a safety harness connection assembly 400 is illustrated in FIGS. 15A through 17. This embodiment includes a D-ring 402 and a device connector system 425. As illustrated in the exploded view in FIG. 16, the D-ring 402 is generally C shaped having a mid-portion 402*a*, a first end portion 402*b* and a second end portion 402*c*. A brace 422 extends across the D-ring 402 proximate the first end portion 402*b* and the second end portion 402*c*. Each of the first end portion 402*b* and the second end portion 402*c* includes a respective D-ring aperture 421*a* and 421*b*. The D-ring apertures 421*a* and 421*b* are aligned with each other.

The device connector system 425 of the safety harness connection assembly 400 includes a base member 410, a gate member 430 and a lock member 450. The base member 410 includes a base plate 412. At one end of the base plate 412 a stop plate 414 extends. The stop plate 414 is shaped to bend over a portion of the base plate 412. Proximate an opposite end of the base plate 412 extends out a pair of base arms 416*a* and 416*b*. Each base arm 416*a* and 416*b* extends generally in a perpendicular fashion in relation to the base plate 412. The base arms 416*a* and 416*b* are spaced in a parallel fashion in relation to each other generally by a width of the base plate 412. The first base arm 416*a* includes a first base arm first aperture 411*a* and a spaced first arm second aperture 413*a*. The second base arm 416*b* includes a second base arm first aperture 411*b* and a spaced second arm second aperture 413*b*. The first base arm first aperture 411*a* is aligned with the second base arm first aperture 411*b* and the first base arm second aperture 413*a* is aligned with the second base arm second aperture 413*b*.

The gate 430 includes a gate base plate 432. Extending from opposite sides of the gate base plate 432 proximate a first end of the gate base plate 432 are parallel first and second gate arms 434*a* and 434*b*. Portions of the ends of the gate arms 434*a* and 434*b* terminate in respective stop edges 435*a* and 435*b*. Moreover, extending from opposite sides of the gate base plate 432 proximate a second end of the gate base plate 432 are parallel first and second connecting tabs 431*a* and 431*b*. Although only connecting tab 431*a* is shown in FIG. 16, the opposite connecting tab 431*b* (shown in FIG. 15C) is a mirror image of connecting tab 431*b*. Each connecting tab 431*a* and 431*b* includes a pivot connection aperture 433. The first and second gate arms 434*a* and 434*b* and the connecting tabs 431 extend generally in the same direction in a perpendicular fashion in relation to the gate base plate 432. The lock member 450 includes a lock plate 452. The lock plate 452 includes a first edge 446*a* and an opposed second edge 446*b*. The lock plate 452 further includes a third edge 448*a* and an opposed fourth edge 448*b*. The lock plate 452 includes a pair of spaced parallel first and second lock stop arms 454*a* and 454*b* that generally extend from the first edge 446*a* of the lock plate 452. The lock plate 452 further includes a first connecting tab 456. The first connecting tab 456 generally extends perpendicular from the lock plate 452 from the fourth edge 448*b* proximate the second edge 446*b*. The first connecting tab 456 includes a first lock plate aperture 457. A second connecting tab 458 generally extends perpendicular from the lock plate 452 from the third edge 448*a* proximate the second edge 446*b*. The second connecting tab 458 having a second lock plate aperture 459 that is aligned with the first lock plate aperture 457 of the first connecting tab 456. Extending generally perpendicular from the second connecting tab 458 is a third tab 451 in such a manner that the third tab 451 is positioned over and parallel with the lock plate 452. The third tab includes indicium that conveys the direction to move the lock plate 452 to unlock the gate 430. The lock plate 452 in this example embodiment includes a lock slot 453 that extends a select distance between the first connecting tab 456 and the second connecting tab 458.

The device connector system 425 of the safety harness connector assembly 400 further includes a lock biasing member 408, a gate biasing member 406, a dorsal rivet 470 and connection rivet 460. The dorsal rivet 470 includes a mid-portion 470*a* and ends that terminate in heads 470*b* and 470*c*. The connection rivet 460 includes a mid-portion 460*a*, a head 460*b* and a connecting end 460*c*. The connecting end 460*c* has a diameter that is less than the diameter of the mid-portion 460*a*. A connection nut 461 engages the connecting end 460*c* of the connection rivet 460. The base arms 416*a* and 416*b* of the base member 410 of the device connector system 425 is positioned between the first and second ends 402*b* and 402*c* of the D-ring such that the D-ring apertures 421*a* and 421*b* are aligned with the first base arm first aperture 411*a* and the second base arm first aperture 411*b* of the base member 410. The dorsal connection rivet 470 is received in the D-ring apertures 421*a* and 421*b* and first base arm first aperture 411*a* and the second base arm first aperture 411*b* to pivotally couple the base member 410 of the device connector system 425 to the D-ring 402. The lock member 450 and gate member 430 are positioned between the base arms 416*a* and 416*b* of the base member 410 such that first base arm second aperture 413*b* and the second arm second aperture 413*b* of the base member 410 are aligned with the second lock plate aperture 459 and the first lock plate aperture 457 of the lock member 450 and the gate apertures 433 of the gate 430. The connector rivet 470 is received in the first base arm second aperture 413*a* and the second arm second aperture 413*b* of the base member 410 and the second lock plate aperture 459 and the first lock plate aperture 457 of the lock member 450 and the gate apertures 433 of the gate 430 to pivotally couple the gate member 430 to the base member 410. The gate arms 434*a* and 434*b* of the gate member 430 are further aligned with gate passages 417*a* and 417*b* in the base member 410.

Figure 15A:
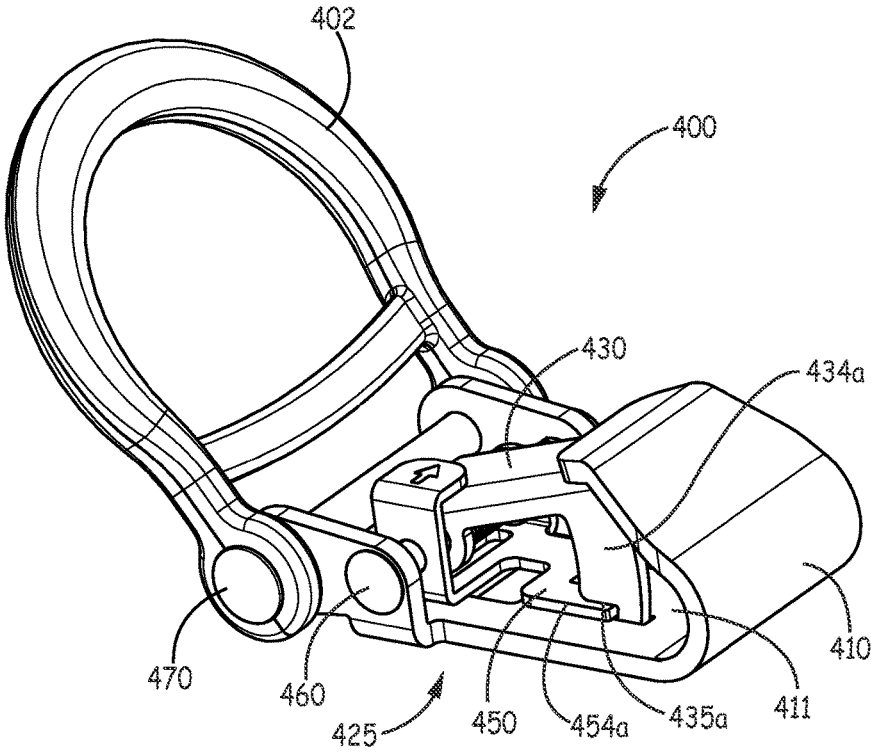
FIG. 15A is a side perspective view of still another safety harness connector assembly of one embodiment of the present invention.
Figure 15D:
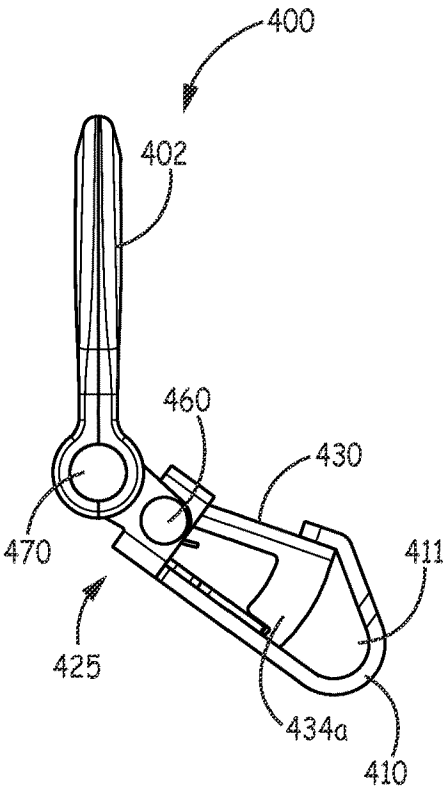
FIG. 15D is a first side view of the safety harness connector assembly of FIG. 15A.
Figure 15C:
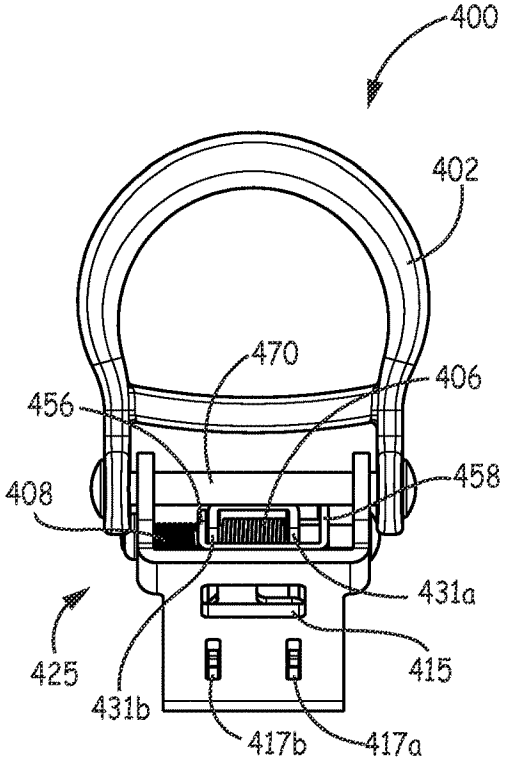
FIG. 15C is a back view of the safety harness connector assembly of FIG. 15A.
Figure 15B:
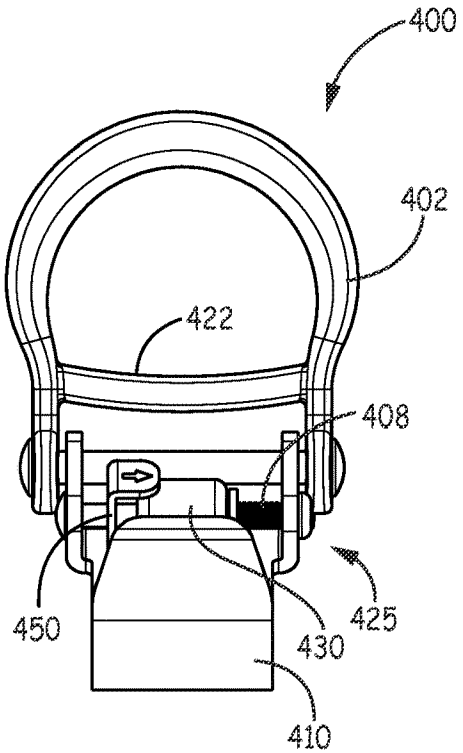
FIG. 15B is a front view of the safety harness connector assembly of FIG. 15A.
Figure 16:
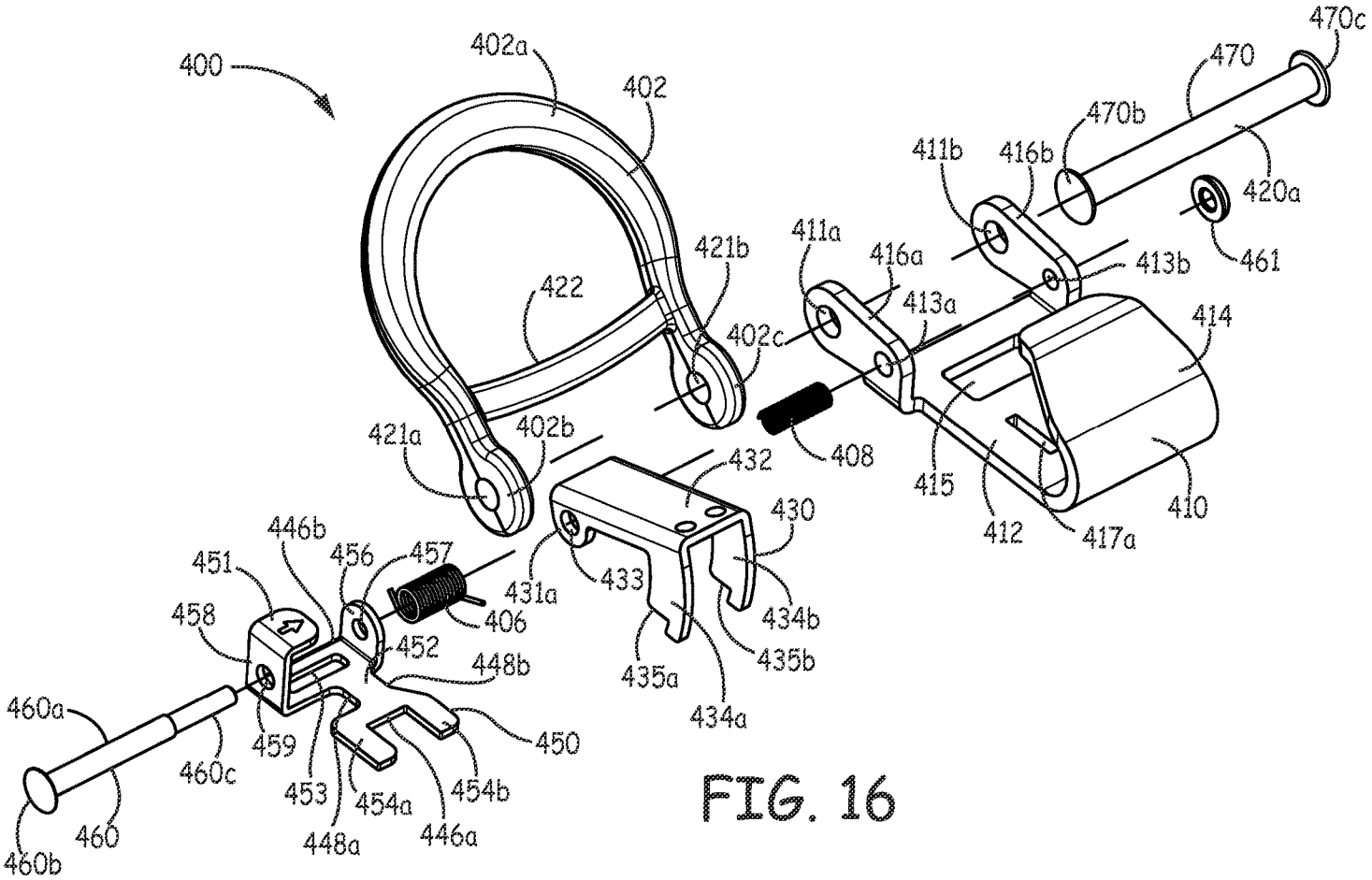
FIG. 16 is an exploded side view of the safety harness connector assembly of FIG. 15A.
Figure 17:
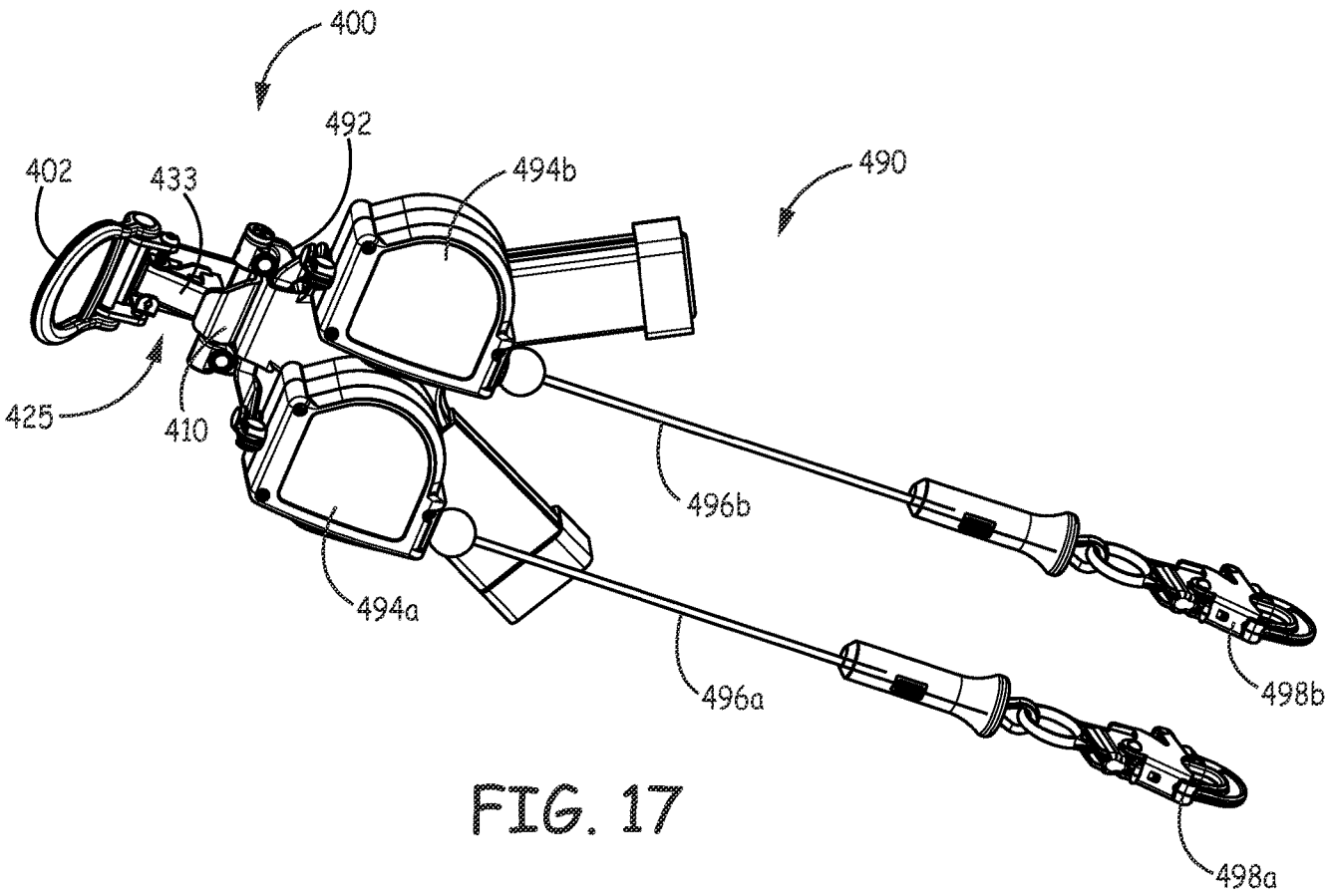
FIG. 17 is a front perspective view of the safety harness connector assembly of FIG. 15A attached to a SRL system.

Gate biasing member 406 receives the mid-portion of the connector rivet 470 and is positioned between the connecting tabs 431*a* and 431*b* of the gate 430 (as shown in FIG. 15C). The gate biasing member 406 is positioned to bias the gate 430 against the stop plate 414 of the base member 410. The lock biasing member 408 also receives the mid-portion 460*a* of the connector rivet 460. The lock biasing member 408 is positioned between the second base arm 416*b* of the base member 410 and the first connecting tab 456 of the lock member 450. The lock biasing member 408 is positioned to bias the lock member 450 into a position that locks the gate 430 in a static configuration in relation to the base member 410. The lock member 450 biased in a lock position is illustrated in FIG. 15A. As illustrated in FIG. 15A, the first lock stop arm 454*a* of the lock member 450 engages the stop edge 435*a* of gate arm 434*a* to prevent the gate arm 434*a* from traveling into the gate passage 417*a* of plate 412 of the base member 410. In the locked configuration, a connector can be held within passage 411 (illustrated in FIG. 15D) of the safety harness connector assembly 400. The gate 430 is opened by asserting a force on the lock member 450 to counter the bias force of the lock bias member 408. This action moves the first and second lock stop arms 454*a* and 454*b* of the lock member 450 away from the gate passages 417*a* and 417*b* of the base member 410. The gate 430 can then be depressed to counter the gate biasing member 406 since the gate arms 434*a* and 434*b* can now pass into the gate passages 417*a* and 417*b* of the base member 410. When the gate is opened a device connector can be placed in passage 411 of the safety harness connector assembly 400. Once the force is removed from the gate 430, the safety harness connector assembly 400 will once again become locked automatically due to the biasing forces of the gate biasing member 406 and the lock biasing member 408. FIG. 17 illustrates the safety harness connector assembly 400 coupled to an SRL system 490 via SRL connector 492. SRL connector 492 has a portion received within passage 411 of the device connector system 425 of the safety harness connector assembly 400. The SRL system 490 in this example embodiment includes a pair of SRLs 494*a* and 494*b*, a pair of lifelines 496*a* and 496*b* and a pair of support structure connectors 498*a* and 498*b*.

Another embodiment of a safety harness connection assembly 500 is illustrated in FIGS. 18A through 20. This embodiment includes a D-ring 502 and a device connector system 525. As illustrated in the exploded view in FIG. 20, the D-ring 502 is generally C shaped having a mid-portion 502*a*, a first end portion 502*b* and a second end portion 502*c*. A brace 522 extends across the D-ring 502 proximate the first end portion 502*b* and the second end portion 502*c*. Each of the first end portion 502*b* and the second end portion 502*c* includes a respective D-ring aperture 521*a* and 521*b*. The D-ring apertures 521*a* and 521*b* are aligned with each other.

The safety harness connector assembly 500 further includes a device connector system 525. The device connector system 525 includes a base member 510 and a connector member 530. The base member 510 includes a tubular portion 512 with a central base passage 515. From a surface of the tubular portion 512 extends first and second base arms 514*a* and 514*b* which, in this embodiment, are mirror images of each other. Moreover, in this embodiment, the first and second base arms 514*a* and 514*b* extend in a parallel fashion with each other from the surface of the tubular portion 512. The first base arm 514*a* includes a first base arm aperture 513*a* and the second base arm 514*b* includes a second base arm aperture 513*b*. The first base arm aperture 513*a* is aligned with the second base arm aperture 513*b*. The connector member 530 includes a first link 532 and a second link 534, The first link 532 is coupled to the second link 534 via connector bar portion 536 such that the first link 530 and the second link 534 are positioned parallel to each other while in a perpendicular fashion in relation to the connector bar portion 536. The first link 532 includes a first link first aperture 531*a* and a first link second aperture 533*a*. The second link 532 includes a second link first aperture 531*b* and a second link second aperture 533*b*. The first link first aperture 531*a* of the first link 532 is aligned with the second link first aperture 531*b* of the second link 534. Moreover, the first link second aperture 533*a* of the first link 532 is aligned with the second link second aperture 533*b* of the second link 534. In addition, the connector bar portion 536 is coupled to the first link 532 near the first link second aperture 533*a* and the second link 534 near the second link second aperture 533*b*.

The device connector system 525 further includes a third link 540 that includes a third link first aperture 541*a* and a third link second aperture 543*a* and a fourth link 550 that includes a fourth link first aperture 541*a* and a fourth link second aperture 543*b*. Also included in the device connector system 525 is a dorsal rivet 560 and a connector rivet 570. The dorsal rivet 560 includes a mid-shaft portion 560*a* that terminates in head ends 560*b* and 560*c*. The connector rivet 570 includes a mid-shaft portion 570*a*, a head end 570*b* and a terminal end 570*c*. The terminal end 570 is configured to receive a connecting nut 526. The mid-shaft portion 560*a* of the dorsal rivet 560 is received in the D-ring apertures 521*a* and 521*b* of the D-ring 502, the third link first aperture 541*a* of the third link 540 and the fourth link first aperture 541*b* of the fourth link 550 to pivotally couple the device connector system 525 to the D-ring 502. Further, the mid-shaft portion 570*a* of the connector rivet 570 is received in the third link second aperture 543*a* of the third link 540, the first link first aperture 531*a* of the first link 532, the central passage 515 of the base member 510, the second link first aperture 531*b* of the second link 534 and the fourth link second aperture 543*b* of the fourth link 550.

Figure 18A:
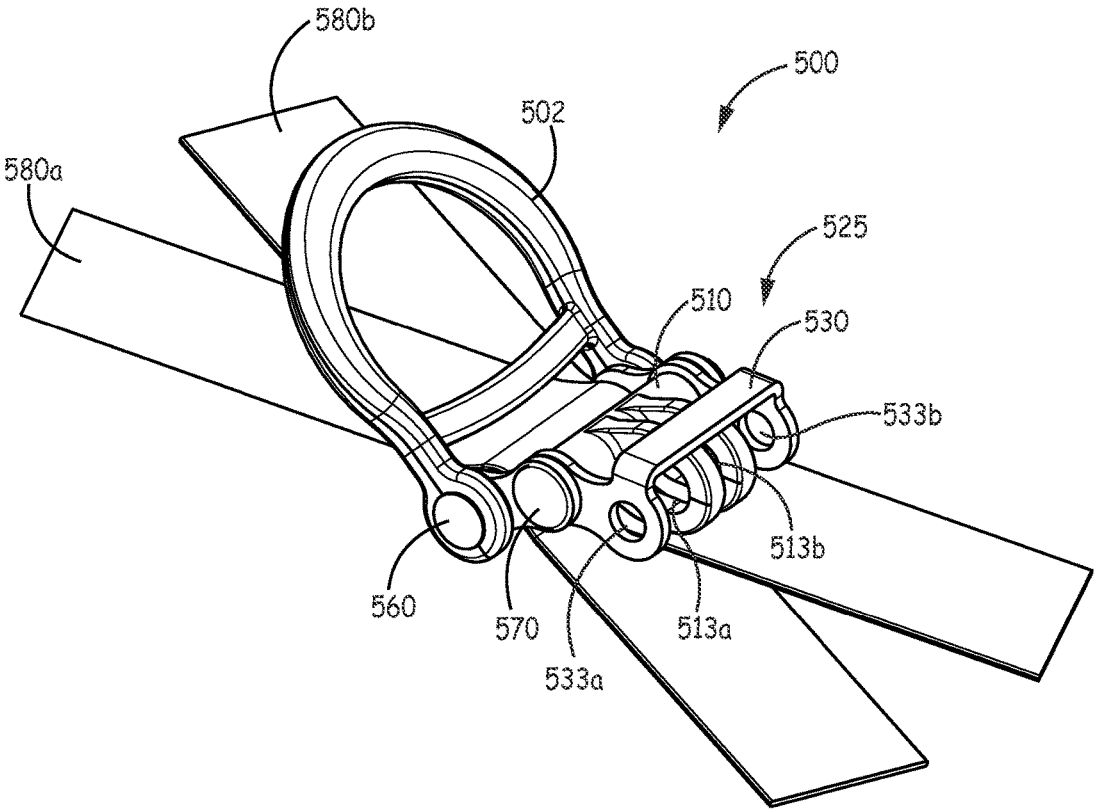
FIG. 18A is a side perspective view of another safety harness connector assembly of one embodiment of the present invention.
Figure 18B:
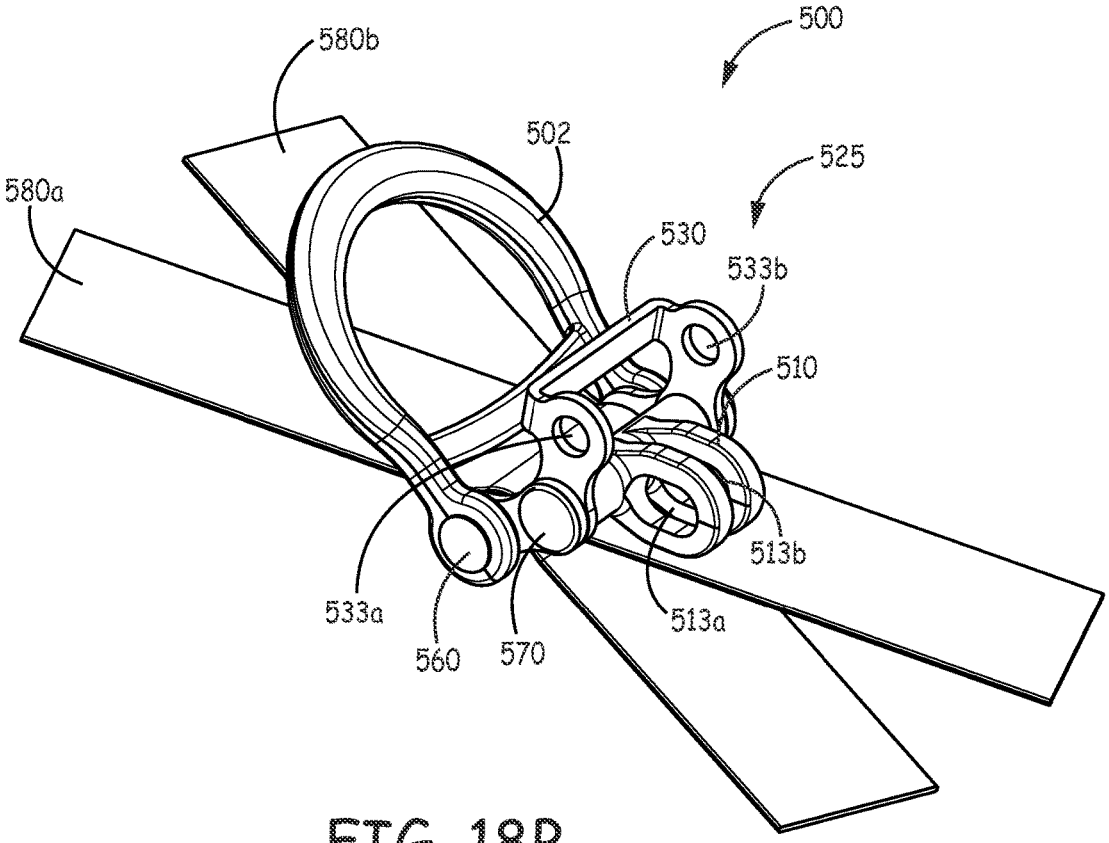
FIG. 18B is a side perspective view of the safety harness connector assembly of FIG. 18A with the device connector system in a different configuration.
Figure 19:
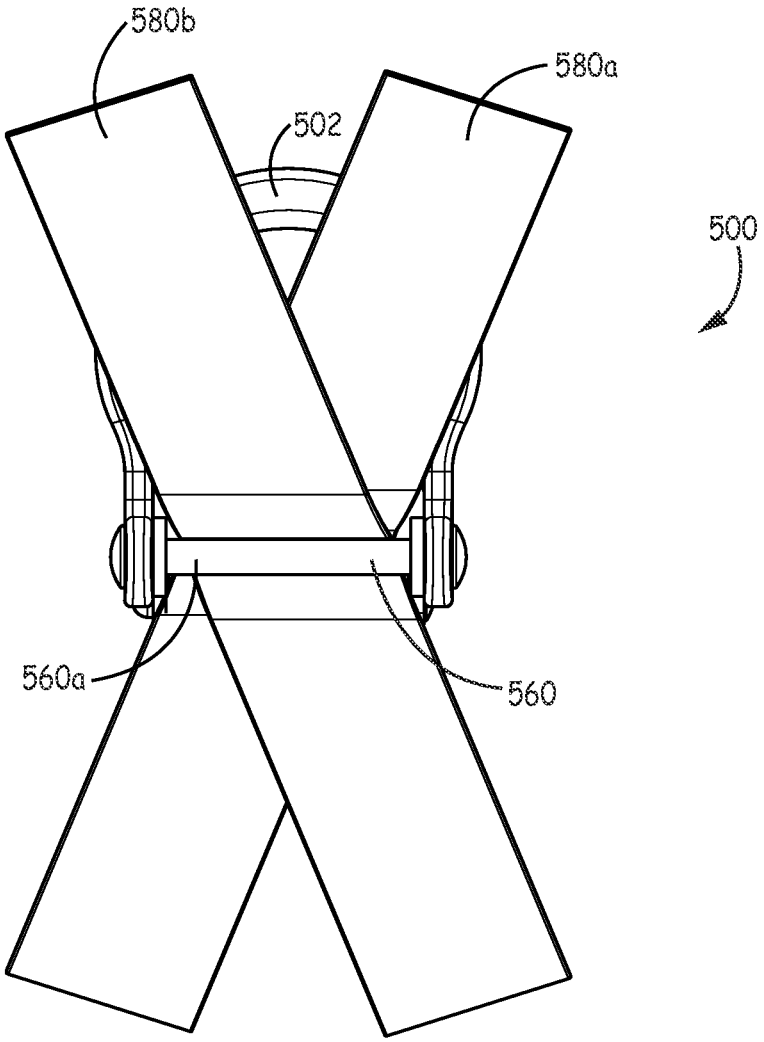
FIG. 19 is a back view of the safety harness connector assembly of FIG. 18A.
Figure 20:
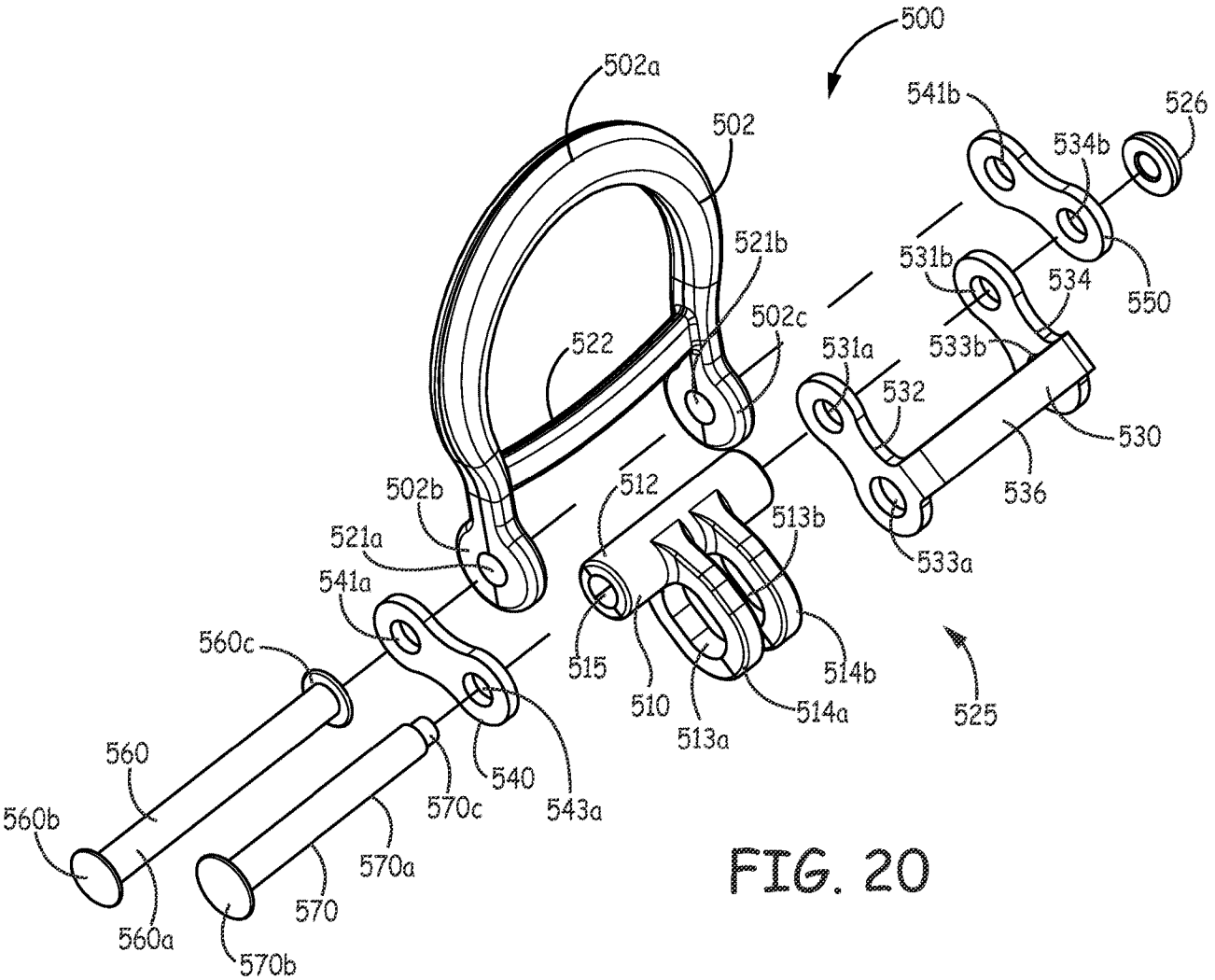
FIG. 20 is an exploded side perspective view of the safety harness connector assembly of FIG. 18A.

FIG. 18A illustrates the device connector system 525 in a first configuration. In this configuration, the first link second aperture 533*a*, the first base arm aperture 513*a*, the second base arm aperture 531*b*, and the second link second aperture 533*b* are all aligned to receive a connector that would be used to couple a device to the webbings 580*a* and 580*b*. In FIG. 18B, the connector member 530 is pivoted about connector rivet 570 so that the first link second aperture 533*a* and the second link second aperture 533*b* are no longer aligned with the first base arm aperture 513*a* and the second base arm aperture 513*b*. This configuration allows for a different type of connector to be used. FIG. 19 illustrates how the webbings 580*a* and 580*b* are routed around the mid-shaft portion 560*a* of the dorsal rivet 560 to couple the safety harness connector assembly 500 to the webbings 580*a* and 580*b*.

Figure 22:
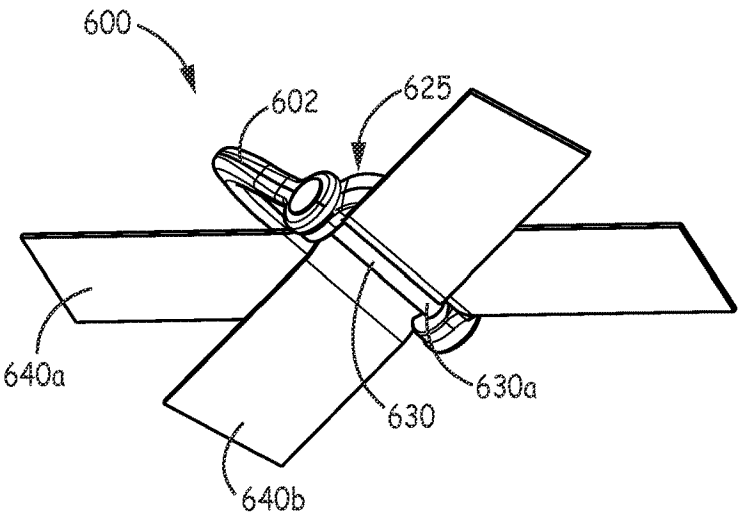
FIG. 22 is a back perspective view of the safety harness connector assembly of FIG. 21A.
Figure 23:
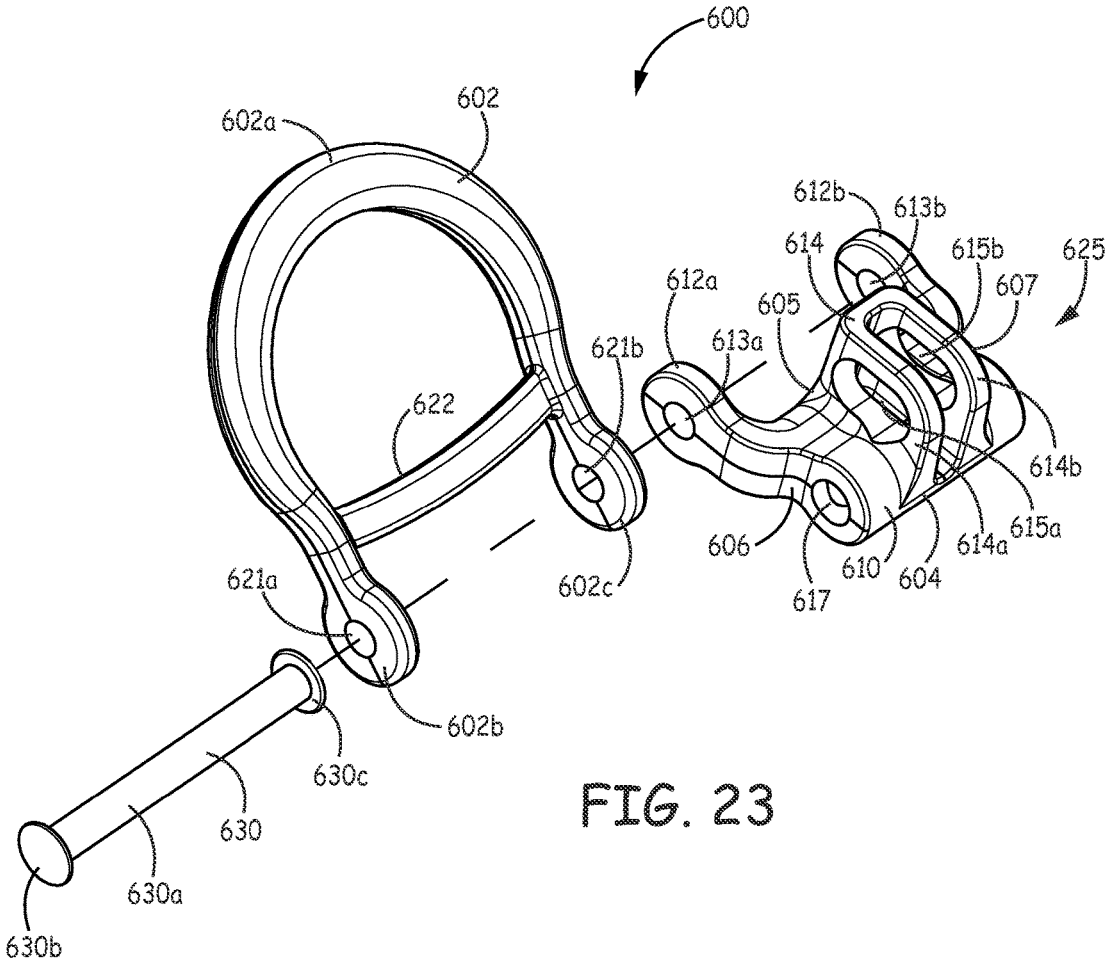
FIG. 23 is an exploded side perspective view of the safety harness connector assembly of FIG. 21.

Referring to FIGS. 21 through 26C another safety harness connection assembly 600 embodiment is illustrated. In this embodiment, the safety harness connection assembly 600 includes a D-ring 602 and device connector system 625. Referring to FIG. 23, the D-ring 602 is generally C shaped having a mid-portion 602*a*, a first end portion 602*b* and a second end portion 602*c*. A brace 622 extends across the D-ring 602 proximate the first end portion 602*b* and the second end portion 602*c*. Each of the first end portion 602*b* and the second end portion 602*c* includes a respective D-ring aperture 621*a* and 621*b*. The D-ring apertures 621*a* and 621*b* are aligned with each other.

The device connector system 625 includes a base member 610 as best illustrated in FIG. 23. The base member 610 has a first edge 604 and an opposed second edge 605. The base member 610 further has a third edge 606 and an opposed fourth edge 607. A bore passage 617 extends through the base member 610 from the third edge 606 to the fourth edge 607. The bore passage 617 is positioned near the first edge 604 of the base member 610. Spaced first and second arms 612*a* and 612*b* extend out from the second edge 605 of the base member 610. The first arm 612*a* includes a first arm aperture 613*a* and the second arm 612*b* includes a second arm aperture 613*b*. The first arm aperture 613*a* and the second arm aperture 613*b* are aligned with each other. A generally U-shaped connection member 614 extends out from a surface of the base member 610 in a perpendicular fashion. An opening to the U-shape faces the first edge 604 of the base member 610. The connection member 614 includes a first wall 614*a* and a second wall 614*b* that are generally positioned parallel to each other. The first wall 614*a* includes a first wall aperture 615*a* and the second wall 614*b* includes a second wall aperture 615*b*. The first wall aperture 615*a* and the second wall aperture 615*b* are aligned. The device connector system further includes a dorsal rivet 630. The dorsal rivet 630 includes a mid-shaft portion 630*a* that terminates in head ends 630*b* and 630*c*. The arms 612*a* and 612*b* of the base member 610 are positioned between the end portions 602*b* and 602*c* of the D-ring 602. The mid-shaft portion 630*a* of the dorsal rivet 630 received in D-ring aperture 621*a*, first arm aperture 613*a*, second arm aperture 613*b* and D-ring aperture 621*b* pivotally couples the device connector system 625 to the D-Ring 602.

Figure 21:
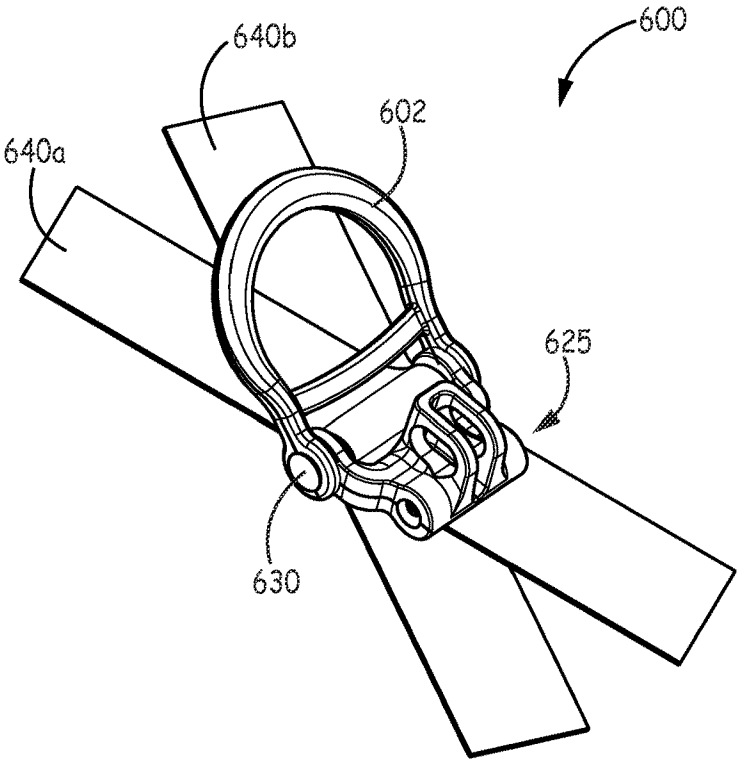
FIG. 21 is a side perspective view of still another safety harness connector assembly of one embodiment of the present invention.
Figure 24:
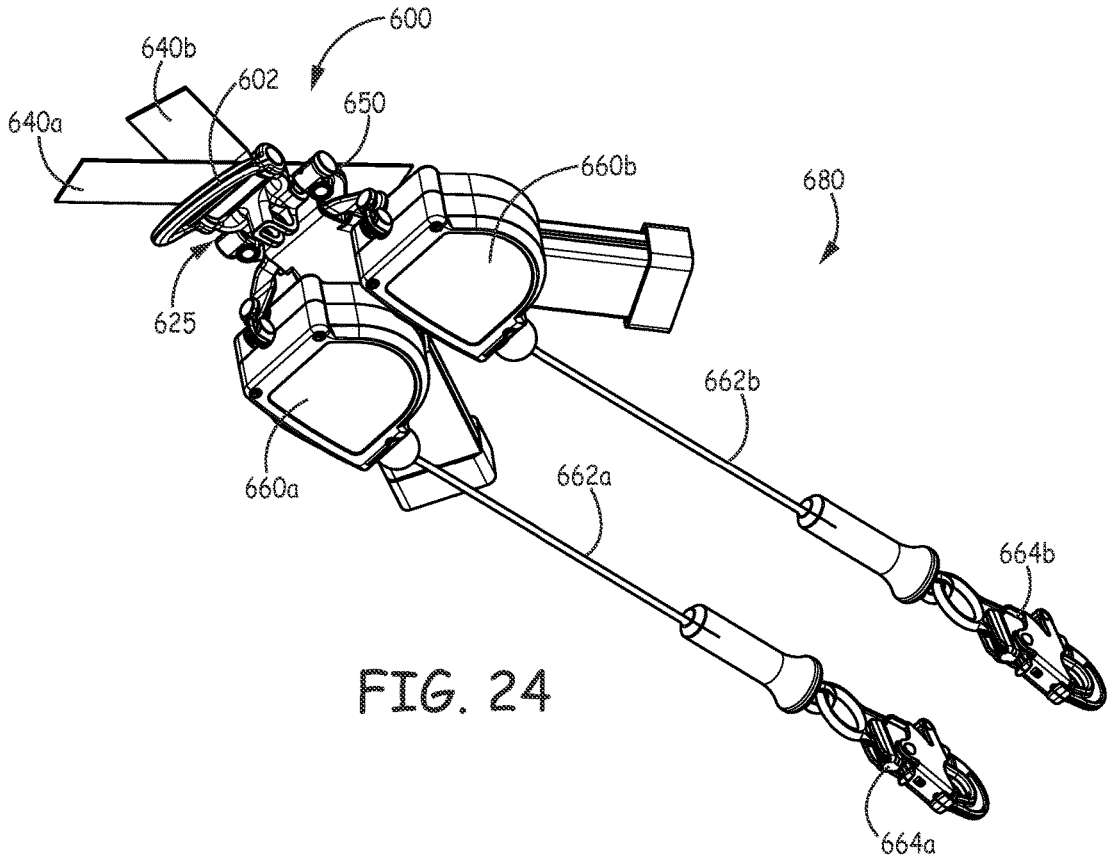
FIG. 24 is a front perspective view of a SRL system coupled to the safety harness connector assembly of FIG. 21.
Figure 25:
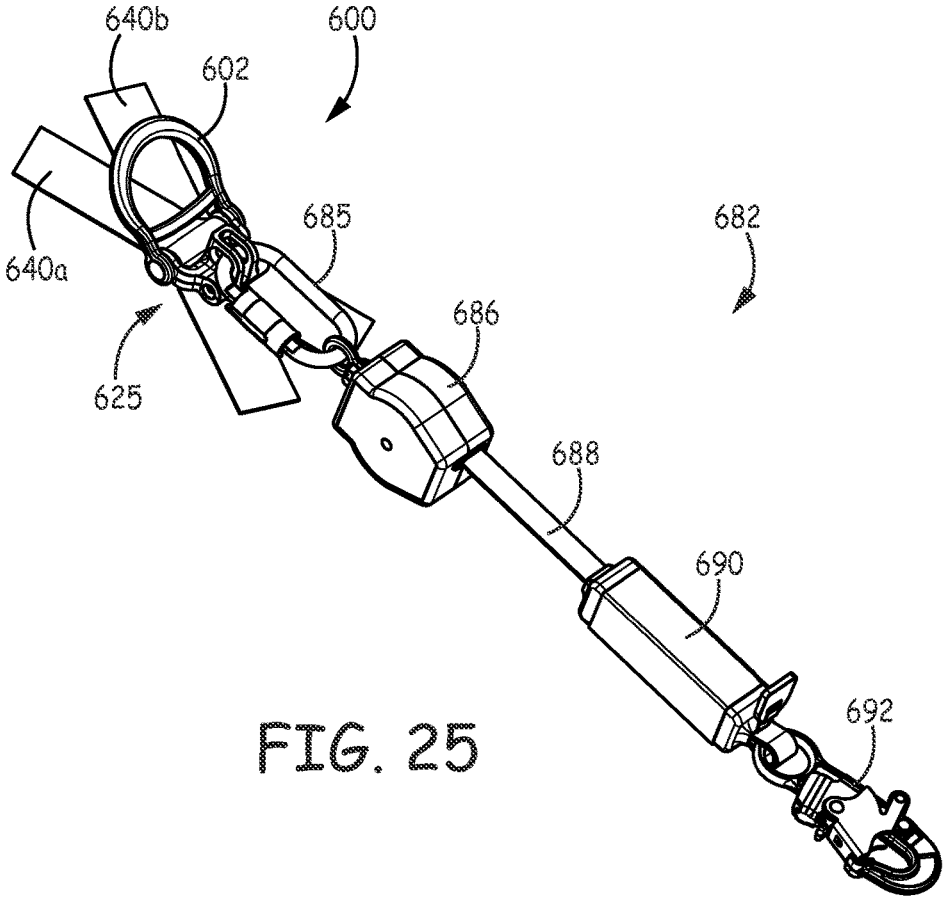
FIG. 25 is a side perspective view of another SRL system coupled to the safety harness connector assembly of FIG. 21.

FIG. 21 illustrates the safety harness connection assembly 600 coupled to webbings 640*a* and 640*b* of a safety harness (not shown). FIG. 22 illustrates a back view of the safety harness connection assembly 600 coupled to webbings 640*a* and 640*b*. As illustrated, the webbings 640*a* and 640*b* are routed around the mid-shaft portion 630*a* of the dorsal rivet 630 to couple the safety harness connection assembly 600 to the webbings 640*a* and 640*b*. FIG. 24 illustrates the safety harness connection assembly 600 coupled to a SRL system 680 via SRL connector 650 being received in the bore passage 617 of the base member 610. The SRL system 680 in this example includes a pair of SRLs 660*a* and 660*b*, a pair of safety lines 662*a* and 662*b* and a pair of support structure connectors 664*a* and 664*b*. FIG. 25 illustrates the safety harness connection assembly 600 coupled to another SRL system 682 via carabiner 685 received in the first wall aperture 615*a* and the second wall aperture 615*b* of the base member 610. The SRL system in this embodiment includes a SRL 686, lifeline 688, energy absorber 690 and support structure connector 692.

Figures 26A, 26B, 26C:
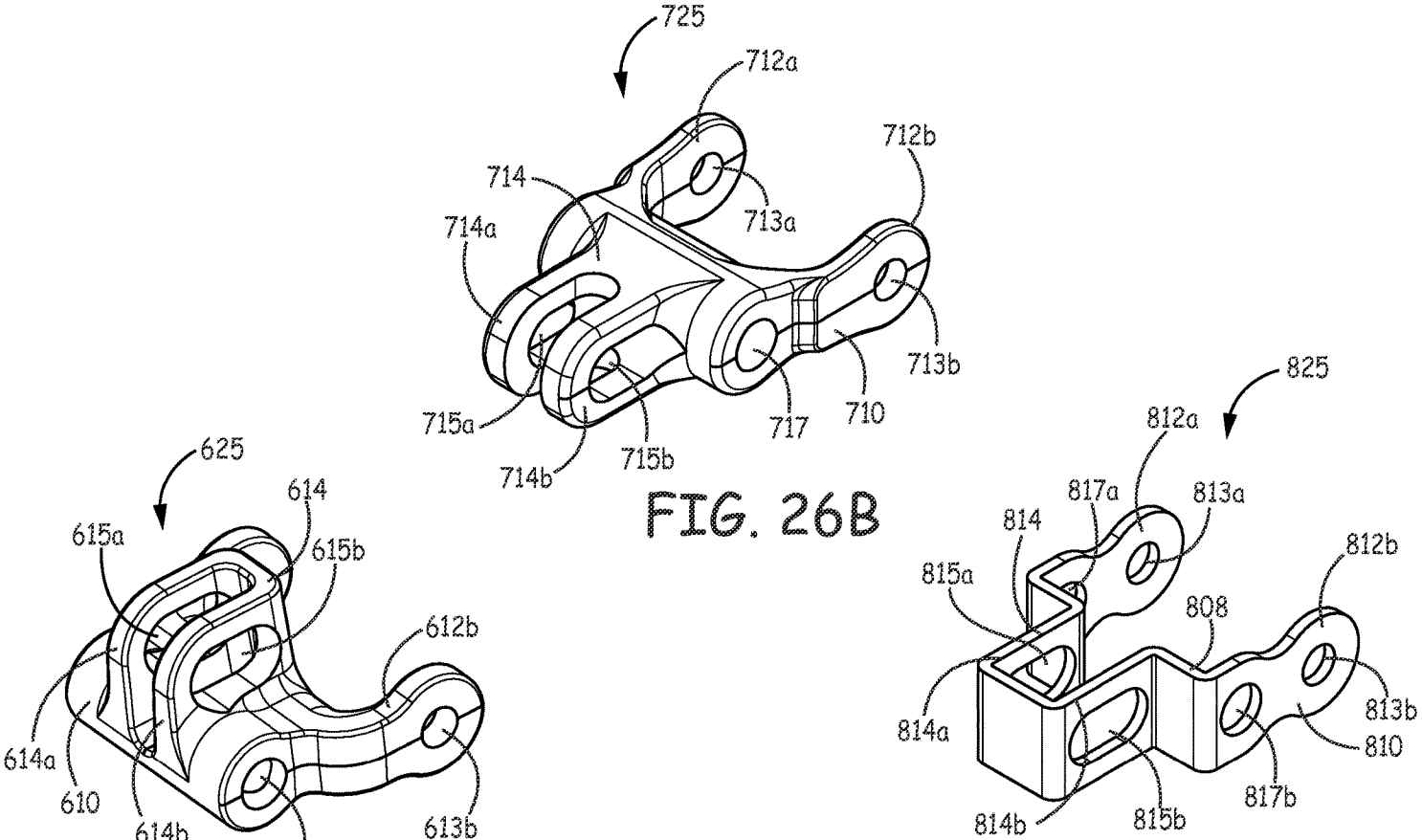
FIG. 26A is a side perspective view of a device connector system of the safety harness connector assembly of FIG. 21.
FIG. 26B is a side perspective view of a device connector system of another embodiment of the present invention.
FIG. 26C is a side perspective view of a device connector system of another embodiment of the present invention.

FIG. 26A illustrates the device connector system 625 as discussed above. FIG. 26B illustrates an alternative embodiment to the device connector system 625 that could be used in the safety harness connection assembly 600 described above. The device connector system 725 of FIG. 26B includes a base member 710. The base member 710 includes arms 712*a* and 712*b* and aligned arm passages 713*a* and 713*b* as well as a bore passage 717 similar to what is describe in relation to device connector system 625. Device connector system 725 differs in that the connection member 714 extends out from an edge of the base member 710 in an opposite direction from the arms 712*a* and 712*b*. The connection member 714 includes walls 714*a* and 714*b* that includes aligned wall passages 715*a* and 715*b*. Another example device connector system 825 is illustrated in FIG. 26C. In this example embodiment, the base member 810 is generally U-Shaped including a first arm 812*a*, a second arm 812*b* and a bridge portion 808. The bridge portion 808 is coupled between ends of the first arm 812*a* and second arm 812*b*. The first arm 812*a* includes a first arm passage 813*a* that is aligned with a second arm passage in the second arm 812*b*. The arms 812*a* and 812*b* includes respective aligned bore passages 817*a* and 817*b*. The aligned bore passages 817*a* and 817*b* are located near the bridge portion 808. Extending from a mid-portion of the bridge portion 808 is a connection portion 814. The connection portion 814 is also generally U-shaped having a first wall 814*a* and an opposed second wall 814*b*. The first wall 814*a* includes a first wall passage 815*a* and the second wall 814*b* includes a second wall passage 815*b* that is aligned with the first wall passage 815*a*. Hence, different interchangeable device connector systems 625, 725 and 825 can be used with the safety harness connection assembly 600.

Referring to FIGS. 27 through 30, another embodiment of a safety harness connection assembly 900 is illustrated. This embodiment includes a D-ring 902 and a device connector system 925. As illustrated in the exploded view in FIG. 29, the D-ring 902 is generally C shaped having a mid-portion 902*a*, a first end portion 902*b* and a second end portion 902*c*. A brace 922 extends across the D-ring 902 proximate the first end portion 902*b* and the second end portion 902*c*. Each of the first end portion 902*b* and the second end portion 902*c* includes a respective D-ring aperture 921*a* and 921*b*. The D-ring apertures 921*a* and 921*b* are aligned with each other.

Figure 29:
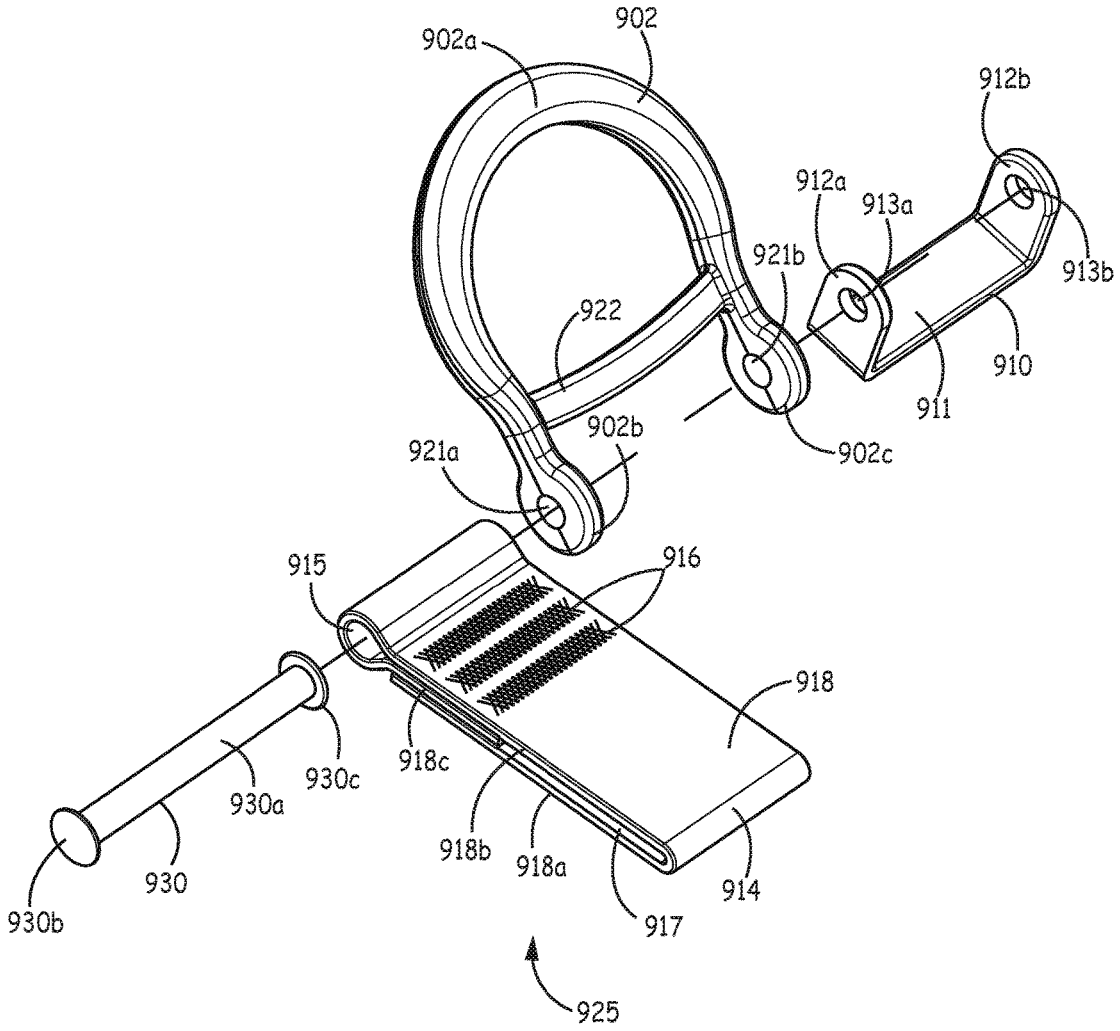
FIG. 29 is an exploded side perspective view of the safety harness connector assembly of FIG. 27.

The safety harness connector assembly 900 further includes a device connector system 925 as best shown in FIG. 29. The device connector system 925 includes a base member 910 and a connector member 914. The base member 910 includes a base plate 911. First and second arms 912*a* and 912*b* extend perpendicularly from opposite ends of the base plate 911. The first arm 912*a* includes a first arm aperture 913*a* and the second arm 912*b* includes a second arm aperture 913*b*. The first arm aperture 913*a* is aligned with the second arm aperture 913*b*. The connector member 914 in one embodiment is made of a webbing 918 that is folded over on itself to form a dorsal aperture 915 at one end and a device connecting aperture 917 passage at the other end. In particular, the webbing 918 includes a first portion 918*a* upon which a second portion 918*b* is folded over. Further, a third portion 918*c* of the webbing (which is shorter than the first and second portions 918*a* and 918*b* is folded over and positioned between the first portion 918*a* and the second portion 918*b*. The first, second and third portions 918*a*, 918*b* and 918*c* are coupled together where all portions of the webbing overlap. In one embodiment, stitching is used to couple the portions 918*a*, 918*b* and 918*c* together although other methods such as, but not limit to, riveting can be used. The device connector system 925 also includes a dorsal rivet 930. The dorsal rivet 930 includes a mid-shaft portion 930*a* that terminates in head ends 930*b* and 930*c*. The base member 910 is positioned between the first end portion 902*b* and the second end portion 902*c* of the D-ring such that the first and second arm apertures 913*a* and 913*b* of the base plate 910 align with the D-ring apertures 921*a* and 921*b* of the D-ring 902. Further, a portion of the connector member 914 is positioned between the first and second arms 912*a* and 912*b* of the base member 910 such that the dorsal aperture 915 of the connector member 914 is aligned with the first arm aperture 913*a* and the second arm aperture 913*b* of the base member 910. The mid-shaft portion 930*a* of the dorsal rivet 930 is received in D-ring aperture 921*a*, the first arm aperture 913*a*, the dorsal aperture 915, the second arm aperture 913*b* and D-ring aperture 921*b* to pivotally couple the device connector system 925 to the D-ring 902.

Figure 27:
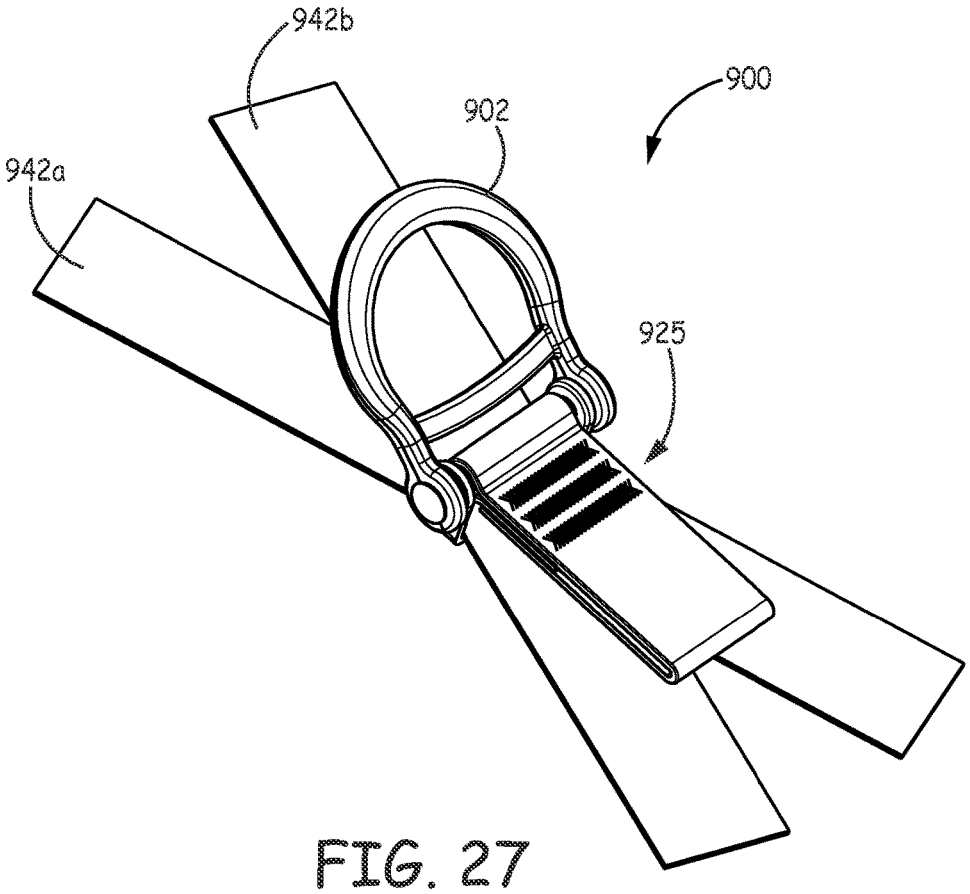
FIG. 27 is a side perspective view of still another safety harness connector assembly of one embodiment of the present invention coupled to harness webbing.
Figure 28:
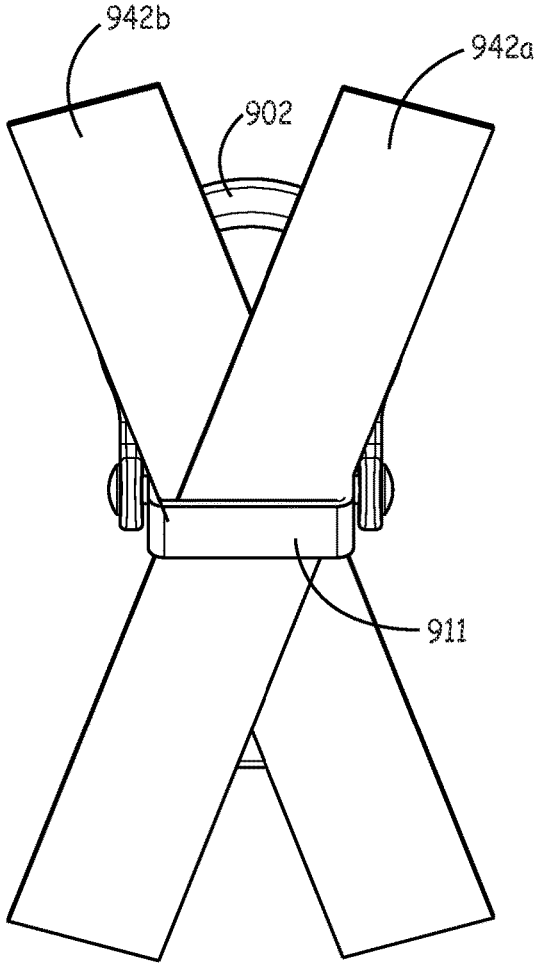
FIG. 28 is a back perspective view of the safety harness connector assembly of FIG. 27.
Figure 30:
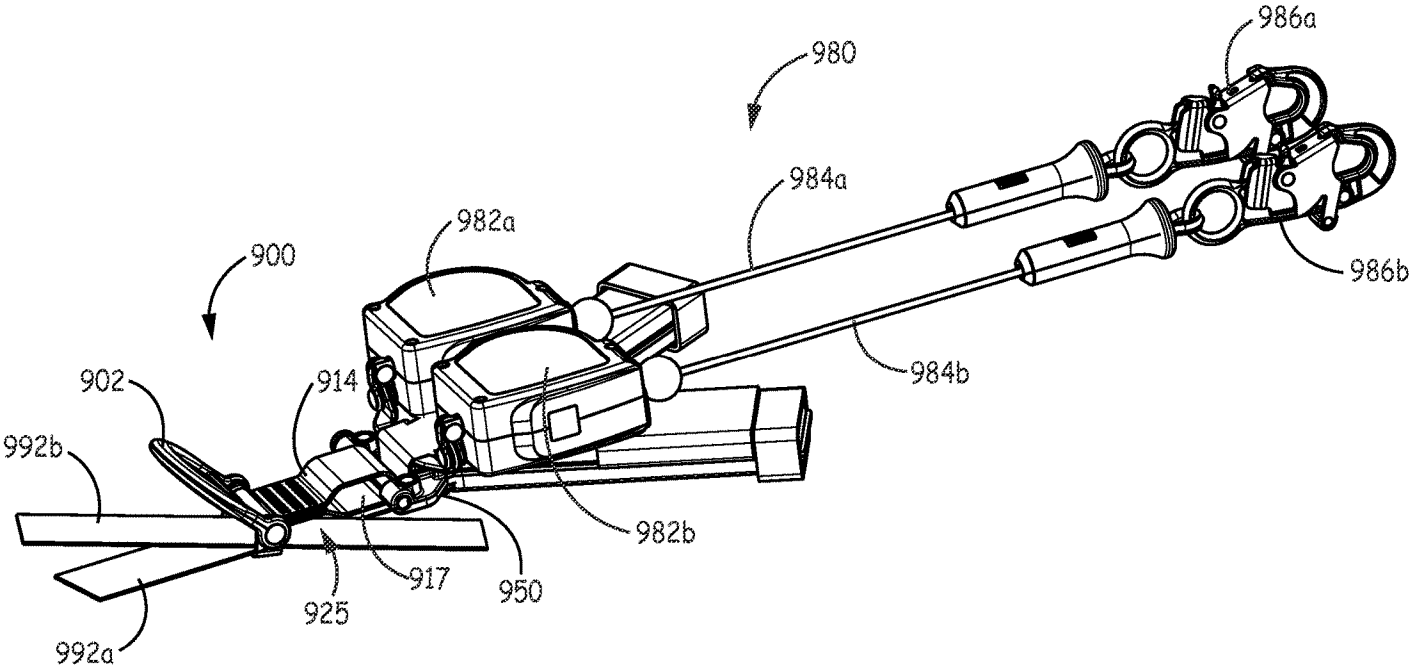
FIG. 30 is a side perspective view of a SRL system coupled to the safety harness connector assembly of FIG. 27.

FIG. 27 illustrates the safety harness connection assembly 600 coupled to webbing 942*a* and 942*b* of a safety harness (not shown). FIG. 28 illustrates a back view of the safety harness connection assembly 900 coupled to the webbing 942*a* and 942*b*. As illustrated the webbings 942*a* and 942*b* are routed between the base plate 911 of the base member 910 and the dorsal rivet 930 (that is received in the dorsal aperture 915 of the connector member 914) to couple the webbings 942*a* and 942*b* to the safety harness connection assembly 900. Referring to FIG. 30, a SRL system 980 coupled to the safety harness connection assembly 900 is illustrated. As illustrated, a portion of a SRL connector 950 is received in the device connecting passage 917 of the connector member to couple the SRL system 980 to the safety harness connection assembly 900. The example SRL system 980 includes a pair of the SRLs 982*a* and 982*b*, a pair of lifelines 984*a* and 984*b* and a pair of support structure connectors 986*a* and 986*b*.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A safety harness connector assembly comprising:

a D-ring having generally a C-shape, the D-ring including a first end portion with a first D-ring aperture, a second end portion with a second D-ring aperture, and a mid-portion that extends between the first end portion and the second end portion, the first D-ring aperture being aligned with the second D-ring aperture;

a shaft received in the first and second D-ring apertures, the shaft comprising a longitudinal shaft axis;

a device connector system comprising:

a base member; and a first connector member pivotally coupled directly to the base member by the shaft to provide for pivotal movement of the first connector member relative to the base member about the shaft axis;

wherein the D-ring is pivotally coupled directly to the first connector member by the shaft to provide for pivotal movement of the D-ring relative to both the base member and the first connector member about the shaft axis.

2. The safety harness connector assembly of claim 1, wherein the base member comprises at least one shaft connection aperture receiving the shaft to pivotally couple the base member directly to the D-ring, and wherein the first connector member comprises at least one device connection aperture to couple one or more safety devices to the safety harness connector assembly.

3. The safety harness connector assembly of claim 1, wherein the base member further comprises at least one base device connection aperture configured and arranged to couple one or more safety devices to the safety harness connector assembly.

4. The safety harness connector assembly of claim 1, wherein the device connector system further comprises:

a swivel connector pivotally coupled to the first connector member; and a second connector member pivotally coupled directly to the swivel connector, the second connector member having a second device connection passage.

5. The safety harness connector assembly of claim 4, wherein the first connector member is configured and arranged to pivot about the shaft axis and the second connector member is configured and arranged to pivot about a second axis, the second axis being generally perpendicular to the shaft axis.

6. The safety harness connector assembly of claim 1, wherein the base member comprises:

a first sidewall;

a second sidewall; and a mid-plate portion coupled between the first sidewall and the second sidewall to form a tray to hold the device connector system.

7. The safety harness connector assembly of claim 6, wherein the base member has a webbing passage configured and arranged to allow webbing from a safety harness to be routed around the shaft to couple the safety harness connector assembly to the webbing of the safety harness.

8. The safety harness connector assembly of claim 1, wherein the base member comprises:

a load attachment member configured and arranged to couple a load member of a safety harness to the base member of the safety harness connector assembly.

9. The safety harness connector assembly of claim 1, wherein the first connector member further comprises:

a first arm, the first arm having a first passage;

a second arm, the second arm having a second passage that is aligned with the first passage of the first arm, the first passage and the second passage receiving the shaft; and a mounting rod the first arm extending from a first end of the mounting rod and the second arm extending from a second end of the mounting rod.

10. The safety harness connector assembly of claim 4, wherein the second connector member further comprises:

a first end portion;

a second end portion, the first end portion and the second end portion pivotally coupled to the swivel connector; and a generally C-shaped mid-portion forming the second device connection passage, the mid-portion of the second connector member further having a slot.

11. The safety harness connector assembly of claim 1 in combination with a safety harness to create a safety harness system.

12. A safety harness connector assembly comprising:

a D-ring having generally a C-shape, the D-ring including a first end portion, a second end portion and a mid-portion that extends between the first end portion and the second end portion, the first end portion having a first D-ring aperture and the second end portion having a second D-ring aperture, the first D-ring aperture being aligned with the second D-ring aperture;

a shaft received in the first D-ring aperture and the second D-ring aperture; and a device connector system configured and arranged to couple devices to the safety harness connector assembly, the device connector system comprising:

a base member pivotally coupled directly to the D-ring by the shaft, a first connector member pivotally coupled directly to the base member, the first connector member being pivotable in a first direction relative to the base member, the first connector member having a first device connection passage, a swivel connector pivotally coupled directly to the first connector member; and a second connector member pivotally coupled directly to the swivel connector, the second connector member being pivotable in a second direction relative to the base member, the second direction being different than the first direction.

13. The safety harness connector assembly of claim 12, wherein the first connector member is configured and arranged to pivot about a first axis and the second connector member is configured and arranged to pivot about a second axis, the second axis being generally perpendicular to the first axis.

14. The safety harness connector assembly of claim 12, wherein the base member further comprises:

a first sidewall;

a second sidewall; and a mid-plate portion coupled between the first sidewall and the second sidewall to form a tray to hold the device connector system, at least the first sidewall, the second sidewall and the mid-plate portion forming a webbing passage configured and arranged to allow webbing from a safety harness to be routed around the shaft to couple the safety harness connector assembly to the webbing of the safety harness.

15. A safety harness connector assembly comprising a device connector system configured and arranged to couple devices to the safety harness connector assembly, the device connector system comprising:

a base member pivotally coupled directly to at least one webbing of a safety harness;

a first connector member pivotally coupled directly to the base member, the first connector member being pivotable in a first direction relative to the base member, the first connector member having first device connection passage, a swivel connector pivotally coupled directly to the first connector member;

a second connector member pivotally coupled directly to the swivel connector, the second connector member being pivotable in a second direction relative to the base member, the second direction being different than the first direction.

16. The safety harness connector assembly of claim 15, wherein the first connector member is configured and arranged to pivot about a first axis and the second connector member is configured and arranged to pivot about a second axis, the second axis being generally perpendicular to the first axis.

17. The safety harness connector assembly of claim 15, further comprising:

a D-ring having generally a C-shape, the D-ring including a first end portion, a second end portion and mid-portion that extends between the first end portion and the second end portion, the first end portion having a first D-ring aperture and the second end portion having a second D-ring aperture, the first D-ring aperture being aligned with the second D-ring aperture;

a shaft received in the first D-ring aperture and the second D-ring aperture of the D-ring; and the base member including at least one shaft connection aperture to receive the shaft to pivotally couple the base member to the D-ring.

* * * * *